US009950240B2

(12) United States Patent
Ramirez

(10) Patent No.: US 9,950,240 B2
(45) **Date of Patent: *Apr. 24, 2018**

(54) GOLF GLOVES

(71) Applicant: John Ramirez, Redlands, CA (US)

(72) Inventor: John Ramirez, Redlands, CA (US)

( * ) Notice: Subject to any disclaimer, the term of this patent is extended or adjusted under 35 U.S.C. 154(b) by 156 days.

This patent is subject to a terminal disclaimer.

(21) Appl. No.: 14/882,472

(22) Filed: Oct. 14, 2015

(65) Prior Publication Data

US 2016/0074741 A1 Mar. 17, 2016

Related U.S. Application Data

(60) Continuation of application No. 13/923,099, filed on Jun. 20, 2013, now Pat. No. 9,248,364, which is a continuation-in-part of application No. 13/136,272, filed on Jul. 28, 2011, now abandoned, which is a division of application No. 12/322,060, filed on Jan. 29, 2009, now abandoned.

(51) Int. Cl.

| | |
|---|---|
| ***A63B 71/00*** | (2006.01) |
| ***A63B 71/14*** | (2006.01) |
| ***A41D 19/015*** | (2006.01) |
| ***A63B 57/20*** | (2015.01) |
| ***A63B 57/30*** | (2015.01) |

(52) U.S. Cl.

CPC ..... *A63B 71/146* (2013.01); *A41D 19/01547* (2013.01); *A63B 57/207* (2015.10); *A63B 57/353* (2015.10); *A63B 2209/08* (2013.01); *A63B 2209/10* (2013.01)

(58) Field of Classification Search

CPC ..... A63B 71/146; A41D 19/01547

USPC ... 2/16, 158, 159, 160, 161.8, 163, 164, 907

See application file for complete search history.

(56) References Cited

U.S. PATENT DOCUMENTS

| | | | | | |
|---|---|---|---|---|---|
| 474,929 | A * | 5/1892 | Sedmihradsky | A41D 19/00 | 2/163 |
| 1,358,823 | A * | 11/1920 | Burden | A41D 19/015 | 2/163 |
| 1,358,824 | A * | 11/1920 | Burden | A41D 19/015 | 2/161.8 |
| 4,131,952 | A * | 1/1979 | Brenning, Jr. | A41D 19/015 | 2/124 |
| 5,228,142 | A * | 7/1993 | Yoswein-Mcgreen | A61F 13/10 | 2/159 |
| 5,390,372 | A * | 2/1995 | Hashimoto | A63B 71/146 | 2/161.2 |

(Continued)

*Primary Examiner* — Khaled Annis

(57) ABSTRACT

According to the various features characteristics and embodiments of the present invention which will become apparent as the description thereof proceeds, the present invention provides partially fingered gloves intended to increase the overall performance in sports activities including golf. The glove includes a palmar portion and a dorsal portion that cover the palm and back of a user's hand. The glove may include multiple digital segments that entirely cover some of the fingers and may be without a digital segment for a forefinger. In one example, the glove may include enhanced grip capabilities along the glove palmar portion. Primarily because of its unique finger configurations and grip enhancers, the instant invention makes a glove more operable in various sports activities, including for those who play Golf using the conventional interlocking grip.

16 Claims, 10 Drawing Sheets

(56) References Cited

U.S. PATENT DOCUMENTS

| | | | | | |
|---|---|---|---|---|---|
| 6,044,494 | A * | 4/2000 | Kang | A41D 19/01547 | 2/161.1 |
| 6,055,669 | A * | 5/2000 | Albert | A63B 71/148 | 2/161.1 |
| 6,427,248 | B1 * | 8/2002 | Albert | A41D 19/01558 | 2/161.1 |
| 6,553,575 | B1 * | 4/2003 | Davenport | A63B 71/146 | 2/161.1 |
| 8,261,372 | B2 * | 9/2012 | Drab | A63B 71/146 | 2/161.1 |
| 8,458,817 | B1 * | 6/2013 | Babb | A41D 19/0013 | 2/159 |
| 2004/0025224 | A1 * | 2/2004 | Albert | A63B 71/148 | 2/159 |
| 2006/0150356 | A1 * | 7/2006 | Tayler | A47L 13/18 | 15/227 |
| 2008/0120754 | A1 * | 5/2008 | Raymond | A41D 19/01558 | 2/16 |
| 2010/0077526 | A1 * | 4/2010 | Smeltzer | A63B 71/148 | 2/16 |
| 2011/0265238 | A1 * | 11/2011 | Choi | A41D 19/01523 | 2/16 |
| 2013/0191961 | A1 * | 8/2013 | Litke | A63B 71/146 | 2/161.2 |

* cited by examiner

The interlocking grip (RELATED ART)

GOLF GLOVES

This application is a continuation application to application Ser. No. 13/923,099, which is a continuation in part to application Ser. No. 13/136,272, which is a divisional of application Ser. No. 12/322,060, filed January 2009.

FIELD OF THE INVENTION

The present invention relates to sports apparatus and equipment, and uses thereof, used in playing the game of various sports. The present invention and its glove embodiments enhance the overall performance in athletic tasks and/or execution commonly associated during sports play, particularly in, but not limited to golf by configuring to meet the specific requirements of a golfer's weak hand, for example. The present invention unique finger configurations generally completely cover the thumb as well as the middle, ring and pinkie fingers of a user's hand, including the fingertips. Furthermore, the present invention is configured to leave uncovered at least a portion of the distal phalanx of a user's forefinger. Additionally, some embodiments may offer grip enhancers on the palm area, the thumb segment and/or on any existing finger segments, and/or provide an aperture along the middle finger digital segment.

BACKGROUND OF THE INVENTION

An important goal in playing sports is to win. Often that means proper play execution, good ball control, good grip and feel, and proper form in the sports fundamentals. Gloves and other types of hand covers are permitted in most sports. Many individuals use gloves to enhance, in some way, their competitive edge. Indeed, gloves have become so important that different types of gloves have been created for different sports. Even within a sport, different types of gloves have been invented to, among other things, maximize performance in specific tasks.

The use of gloves can increase performance especially when the user needs to grip an object like a ball or golf club, for example. Although generally useful, using prior art conventional gloves in some sports can come with significant drawbacks, especially if a user must use their hands to feel in addition to simply grip an object.

In Golf for example, a golfer grabs a golf club with both hands, and must use his or her hands to grip as well as 'feel' the golf club throughout the golf swing.

This ability to feel is critical when swinging a golf club. Once a golfer begins a golf swing, the golfer cannot not lose sight of the golf ball until impact occurs with the golf ball. Consequently, the golfer must use tactile sensations on the hands to feel if the golf club is on the correct swing plane throughout the golf swing. Once the golf swing begins, the golfer can no longer look at the golf club and must continue to look at the golf ball.

This need to feel the golf club with a hand has therefore resulted in golfers having to make a difficult choice. Although clearly these players would benefit from added grip enhancers on their hand to increase their control and accuracy, prior art gloves force a golfer to choose between all feel and no feel.

Playing the sport of golf without the help of gloves, however, can also be an inferior choice. Quite often a golfer's success requires swinging the golf club to produce significant club speed, especially when teeing off at the beginning of each hole. As the velocity of the golf club increases, it becomes increasingly more difficult to maintain a tight grip on the club; this is especially true at the point of impact with the golf ball. Virtually all active golfers have chosen therefore to enhance grip capabilities and therefore sacrifice the ability to better feel the golf club.

Consequently, in the field of Golf, to be sure, there exists much prior art in the form of gloves for a golfer's weak (non-dominant) hand. In fact, most active golf players wear a glove on their weak hand, and go without a glove for their strong hand (if one were to go to any major store to buy golf gloves, they would be sold and packaged as a single—one glove—not sold in pairs).

More specifically, the current solution to this insoluble problem has been for virtually all golfers to use one and only one glove. This glove is always placed on the weak hand, leaving the strong hand without a glove.

Golfers have generally decided to wear a glove on their weak-hand, thereby increasing the overall grip of the weak hand but, because prior art weak-hand golf gloves are full fingered and therefore cover all of the user's fingers, the weak hand loses significant tactile capabilities. Cognizant of this major deficiency, most golfers will not wear a glove on their dominant hand, presumably to compensate for the loss of tactile sensation from wearing a glove on their weak-hand.

Although this method of gripping a golf club, by wearing only one golf glove, does provide some tactile sensation, the tactile sensation is limited to only the dominant hand so that the weak hand loses significant tactile sensations. This limitation of only allowing skin contact by the dominant hand has often resulted in several problems such as: difficulty in weak-hand and dominant hand coordination because skin contact between hands is blocked by the glove; difficulty in assessing proper golf club positioning by the weak-hand throughout the golf swing; and difficulty in getting proper feedback from weak-hand sensations if one completes an improper golf swing.

It is no surprise that golfers often have difficulty landing a golf ball on the fairway, even at the highest performance levels, and currently remains an insoluble problem in the sport for amateurs and professionals alike.

There is, therefore, a long-standing need to invent a device—and improve prior art—that could offer some 'feel' ability on the weak hand, without significantly diminishing that enhanced grip ability that gloves offer. The result would of course significantly improve the current challenging method of swinging a golf club and increase overall hand control of a golfer's club swing, and greater success in competition.

One very popular golf club grip, for example, is called the interlocking grip. When you use this grip, the forefinger of the golfer's weak-hand is placed over and wrapped around the strong (dominant) hand's pinkie finger. With this grip, clearly the role of the interlocked fingers has less to do with grip and more to do with coordination and feel between the user's two hands to more effectively control the golf swing and to provide greater overall golf swing consistency. There is, therefore, no real need to cover all of the weak hand's forefinger, which touches the dominant hand's interlocked pinkie finger, and uncovering at least part if not all of the forefinger would actually significantly increase overall coordination by allowing the now uncovered portion of the weak hand's forefinger to touch the skin of the dominant hand's pinkie finger. Embodiments of the present invention would therefore offer significant improvements to prior art by offering a glove which leaves at least the fingertips of the forefinger uncovered thereby offering heightened tactile sensations on the weak hand of a user.

The present invention will provide a glove for the weak hand whereby the user may both better grip a golf club as well as maintain enhanced tactile sensitivities on parts of the otherwise gloved hand.

There are other configuration challenges in prior art golf gloves that hinder those desiring to have a proper, consistent golf swing using a conventional golf grip.

Most conventional golf gloves, for example, have ventilation recesses along the dorsal portion of the digital segments including on the forefinger which of course can be counterproductive and problematic especially when gripping a golf club using the interlocking grip. Conventional golf gloves provide recesses on the proximal phalanx of the forefinger which of course channel perspiration to this area, albeit small amounts. This is problematic because the strong hand's pinkie finger interlocks and resides over the forefinger's proximal phalanx. Intentionally trying to channel moisture to this interlocked area will clearly cause unnecessary slipping between the two interlocked fingers and further hinder the user's ability to perform a unison, coordinated golf swing.

On the other hand, without any recesses on the forefinger segment, moisture will inevitably build up within the forefinger segment, making it very uncomfortable for the user; if, however, the distal phalanx of the forefinger is uncovered, for example, any moisture buildup in the forefinger segment will naturally flow out from the uncovered portion and away from the critical interlocked or overlayed portion.

For the same reasons, recesses along the middle finger's proximal phalanx may be counterproductive as well.

Solving these unrecognized problems, as embodiments of the present invention provides, will go a long way to significantly enhance consistent golf swing control, especially during hotter weather conditions. Some embodiments include a forefinger segment without any moisture management recesses along the proximal phalanx on the forefinger segment and/or along portions of the middle finger segment, where the strong hand's pinkie finger usually rests on the weak hand.

Providing a more strategic moisture management system will create a firmer contact between the fingers of both hands, and therefore a more controlled golf swing.

There is also a long existing need for a device that could offer better hand coordination between a golfer's strong hand and weak hand without significantly diminishing a golfer's ability to adequately grip the golf club. Golfers often have to fight completing a 'slice.' When a golfer hits a slice, the golf ball flies to the far outside (far right for a right-handed golfer or far left for a left-handed golfer).

A slice can take place for several reasons. One reason has to do with the dominant hand not moving at the same rate and angle as the weak hand during a golf swing, or not unhinging at the same time. If there is even the slightest separation between the two hands during the golf swing, the club face will not be square at impact; the resulting open face impact will inevitably result in a slice. An ideal location to help determine if there is even slight hand separation resides where the weak hand's middle finger touches the strong hand's pinkie finger. If the golfer is using prior art golf gloves, however, it is extremely difficult to feel if there is any hand separation throughout the golf swing because of the weak hand's middle finger loss of significant tactile sensations by being completely covered by the glove.

Inventing a solution to this problem could, among other things, allow for greater golf swing control and consistency by providing a golfer with significantly enhanced and immediate feedback with a golf swing, and thus create an entirely new market to support a golfer's dominant (strong) hand and weak hand coordination.

Some glove embodiments of the present invention offer an aperture along the weak hand's middle finger such that the skin of the weak hand's middle finger can touch the skin of the strong-hand's pinkie finger, thereby providing immediate and accurate feedback if there was any separation between the user's hands throughout the golf swing and make the proper adjustments. Among the results would be improving ball contact, trajectory and accuracy by minimizing hand separation throughout the golf swing.

The weak hand's middle finger requires a unique blend of grip and sensitivity capabilities. Providing added grip capabilities along the middle finger would allow a user to better maintain control; providing an aperture along the dorsal segment's proximal phalanx of the middle finger would simultaneously allow the user to maintain tactile sensitivities whereby at least a portion of the middle finger's skin would touch the weak hand.

Consequently, there are clear indications that an entirely new market exists for a device that could support a golfer's hand coordination, especially but not limited to those who play golf using the interlocking grip. In particular, there remains an unmet need that would provide multiple benefits, such as better overall grip and more coordination with both hands during the practice or play of golf, and in various other sports activities. The present invention solves the above mentioned problems by, among other things, providing a glove configured for use on the weak hand that can increase grip abilities on areas primarily responsible for the gripping a golf club, while allowing portions of the other fingers to be uncovered and able to maintain necessary feeling capabilities.

DETAIL DESCRIPTIONS OF THE INVENTION

The present invention provides a glove having dorsal (back) and palmar (front) portions for overlaying respective back and palm regions of a human hand, and dorsal and palmar portions having distal and proximal ends with a plurality of digital segments (or stalls) projecting from said distal ends. The digital segment of the thumb covers the entire thumb including the fingertip of said thumb of a user, the digital segment of the middle finger generally covers the entire middle finger including the fingertip of said middle finger of a user, the digital segment of the ring finger covers the entire ring finger including the fingertips of said ring finger of a user, and the digital segment of the pinkie finger covers the entire pinkie finger including the fingertip of said pinkie finger of a user.

Additionally, at least a portion of a user's forefinger's distal phalanx will be uncovered.

In one preferred aspect, a forefinger digital segment exists whereby only the forefinger's distal phalanx is uncovered, in its entirety, therefore a forefinger segment will exist on the embodiment that covers a user's proximal and middle phalanges, in their entirety.

In another embodiment, a user's forefinger is completely uncovered, therefore no forefinger segment will exist in the embodiment.

Preferably, at least a portion of the forefinger's proximal phalanx is covered, therefore a forefinger segment will exist that covers at least a portion of a user's proximal phalanx and leaves uncovered at least a portion of the distal phalanx of said forefinger such that the fingertips would be exposed to have heightened tactile sensitivities.

Accordingly, embodiments provide a novel glove that takes into account a user's preferred golf grip, such as the interlocking grip, for example, by allowing the interlocked forefinger to be better able to feel the dominant hand while allowing other fingers of the gloved hand to maintain heightened grip capabilities.

In another preferred aspect, the present invention also comprises a grip enhancing means, such as PVC dots for example, on a portion or portions of the palmar surface area of the glove, such as for example, on any thumb and finger stalls where a finger segment exists, along any portion of any metacarpophalangeal joints, and/or between the thumb and forefinger area, generally defined by the metacarpal of the forefinger and extending up along the metacarpal of the thumb, and therebetween.

The grip enhancing means can therefore be specifically positioned to provide enhanced grip and a higher coefficient of friction along select areas of the palmar portion of the glove. The grip enhancing means will offer a golfer multiple benefits such as increased control of a ball or device thereby enhancing performance and overall success at performing a sports task. Of course, users may prefer any combination of the aforementioned. In at least one embodiment all of the above mentioned areas will comprise of a grip enhancing means including all five metacarpal areas.

For example, an embodiment can comprise of a grip enhancing means overlaying the entire metacarpophalangeal joints of the pinkie finger, ring finger, middle finger and forefinger. The grip enhancing means may be defined by the four finger digital creases and extending down about three centimeters (width), enough to cover the entire metacarpophalangeal joints of said fingers in their entirety. The length would be defined by the two opposing sides of the palm, say about seven to ten centimeters in general. This area would then include, for example, a high friction surface or a textured surface, as the grip enhancing means. The grip enhancing means could be comprised of a beaded surface pattern, for example, projecting out at least ½ millimeter, and which could be integral to the glove material, preferably extending throughout the entire designated surface area, but could certainly be provided on at least one centimeter by one centimeter along the designated outer surface to provide added grip support, such as, for example, only on the metacarpophalangeal joint of the forefinger (provided a forefinger segment exists on the particular embodiment).

In at least one embodiment, the entire palmar surface comprises a grip enhancing means throughout.

In general, the grip enhancing means of the present invention may be integral to the glove or may be affixed to the glove surface by, for example, forming a grip enhancing panel and applying the panel onto a portion of the glove. The finger grip enhancing means of an embodiment could comprise, for example, a high friction textured surface with a more narrow width, say about 1.5 to three centimeters. This and other embodiments may include a plurality of projections on the surface as the gripping means which is formed from, for example, one of a vinyl material, a rubber material, or a neoprene material, creating a grip enhancing panel.

The material forming the panel could then be applied to said finger stalls using any standard bonding methods, such as adhesion or stitching. The projections can preferably be provided, for example, on at least one—or only on one—phalanx of any finger stalls. The projections could preferably extend out less than 1/10 of a centimeter, but could range generally from 1/20 of a centimeter to several centimeters.

In general, the panel may preferably be formed from an elastic material or fabric, including but not limited to, a knitted fabric, for example, lycra, rayon, neoprene, a rubber material, a vinyl material, or the like. Once the grip enhancing surface on the panel has been formed, the panel may then be applied to the palmar surface of the glove by any standard methods, such as by stitches or adhesives, for example.

In general, the grip enhancing means of the present invention generally creates a higher coefficient of friction on the palmar segment of the glove, and can be comprised of various grip-enhancing materials, forms, coatings, and designs, including but not limited to, foams, fabrics, PVC dots, perimeter patching designs, linear and non-linear grooves, or combinations thereof, high friction surfaces, textured surfaces, a plurality of regular or irregular projections, a plurality of regular or irregular depressions, non-slip materials and coatings, such as PVC coatings, nitrile coatings and latex coatings, and designs creating coarse surfaces such as eighty grit Emory cloth for example, as well as pebbled or beaded surfaces, convex or concave bumps, striations, cross-hatches, convex or concave linear and non-linear lines, angled ribs, random structures, convex or concave ridges, crevices, elongated segments, and the like. Preferably, the depths of the depressions and/or heights of projections would be such that the gap formed by the depressions or projections would allow for some movement of the palmar surfaces thereby increasing the grip capabilities of the user. The height or depth ranges can generally begin at about 100 micrometers to several millimeters or more.

The grip enhancing means may further comprise a plurality of spaced apart stripes or striped projections formed from a high friction material, such as a PVC material, for example. Preferably the stripes comprise raised or projecting stripes and are arranged to extend generally parallel to the axis of any existing finger stalls. Stripes and other forms may be uniformly spaced or spaced at varying intervals. Similarly, stripes and other forms may have varying thicknesses, heights or depths, depending on preference. The thickness ranges generally can begin at about 100 micrometers to several millimeters or more. These grip enhancing means may create a pattern, may be in rows or randomly placed, and may form circular and non-circular shapes, such as spherical, cylindrical or elongated. Additionally, they may be individually separated or interconnected.

In general, the palmar surface of an embodiment can have a variety of finishes, one portion of the surface can have a smooth finish, for example, and another portion can have a textured surface. The textured portion could create a coefficient of friction, or grip enhancer, on the surface.

The grip enhancing means can be formed on the glove by any standard method, for example, by embossing, stamping or molding a portion of the glove to create the gripping means. For example, the grip enhancing means can comprise of regular projections of say, about 300 micrometers in height, but may vary in height depending on preference. The projections may all be the same height, and may be in rows. They may be embossed elongated shapes that are interconnected, thus creating a high coefficient of friction throughout the entire palmar surface area of the glove. Other embodiments could of course offer different heights, non-uniform heights, and have a more random pattern on the palmar portions forming the glove.

The grip enhancing means should preferably provide an effective coefficient of friction, preferably of at least a Shore A Durometer of about two or greater.

Accordingly, embodiments provide a novel glove with added grip-enhancing features that enhance overall control and sports performance.

Embodiments may also offer a liner which may be integrally formed on the glove. For example, the liner (or sleeve) could be attached to the glove by standard methods, such as by conventional stitching about the perimeter of the dorsal segment.

The lining material (or sleeve) may be comprised of standard lining materials, such as a smooth, flexible knitted fabric. The liner may also comprise of flexible and elastomeric material such as spandex or LYCRA. Other possible materials include a knit of polyester or simply the same material forming the glove. A soft cellular plastic could also be preferred. Additionally, the liner may provide added features to offer warmth and comfort such as by comprising of a fleece material, for example, especially useful when competing or practicing in colder conditions (or when playing at night, which is beginning to gain in popularity).

It will be apparent to one of ordinary skill in the art that many other implementations of liners are possible.

In yet another aspect, embodiments may also comprise an aperture along the middle finger digital segment of the glove. The aperture will generally leave uncovered at least a portion of the middle finger segment's proximal phalanx. The aperture resides along the proximal phalanx, thereby defining its general boundaries. Within this parameter the location of the aperture (e.g., only on the side of the proximal phalanx or primarily of the top dorsal portion) along the middle finger segment will vary due to user preference and sport being played.

Accordingly, embodiments can also provide a novel glove with features that assist a golfer significantly improve hand coordination by allowing the skin of the weak hand's middle finger to touch the skin of the strong hand's pinkie finger and thereby increase hand coordination throughout a golf swing. Among the benefits of this unique configuration include heightened critical tactile sensitivities to more properly feel if there is any separation between the weak hand's middle finger and the dominant hand's pinkie finger, throughout the golf swing.

The glove may also have an expandable opening means at a wrist end adapted to receive the user's hand. This may comprise of a wrist portion with a securement opening means, such as but not limited to a flap which mechanically engages a flap capture mechanism to secure the glove to the users hand (e.g., a synthetic hook and loop fastening interface which adheres when pressed together, commonly using VELCRO). In this case the flap could overlay a small slit or opening along a portion of the back of the hand to allow the glove to widen when a user places the glove on to the hand. The opening means may comprise of other standard used mechanisms of allowing a user to apply and disengage the glove, such as an elastic band material along the wrist portion, or combinations therebetween.

Embodiments may also comprise of micro-recesses along any portions of the glove, generally used on golf gloves and baseball gloves for ventilation or moisture management purposes. These micro recesses are generally about 0.120 millimeters or so in diameter. These micro recesses are generally not along the proximal phalanx of the middle finger segment or the proximal phalanx of the forefinger, although some embodiments may be configured as such to meet user conventional preferences. Alternatively or additionally, recesses may reside on the glove portion overlaying one or more metacarpophalangeal joints. In at least one embodiment, an aperture will reside on a metacarpophalangeal joint segment, such as along the middle finger metacarpophalangeal joint, to provide added ventilation and added flexibility. The aperture on the metacarpophalangeal joint portions will preferably not extend beyond said joint portions, thereby defining their terminal edges.

Embodiments may further comprise a detachable golf ball marker to more easily allow a golfer to mark the spot of the golf ball's location. The detachable ball marker is secured by any standard fastening means, such as by snap fastening, by a VELCRO fastening compartment, by magnetism, or the like.

The finger segments of embodiments are preferably designed to fit snugly around a user's fingers, as are typical sports gloves. In addition, some embodiments may have material treated by a moisture repellant, for example SCOTCH GUARD or a synthetic resin, extremely useful during harsher weather conditions. Additionally, embodiments may also comprise various weather-resistant and perspirant-resistant materials, forms and designs including, but not limited to, water-resistant materials or micro-recess designs along any portion of the glove, for moisture management, or combinations thereof.

Embodiments may be made and manufactured using standard materials and methods in developing sports gloves. Materials that can comprise these glove embodiments include, but are not limited to, woven materials such as natural, synthetic or blends of natural and synthetic yarns, thermoextruded or thermoset rubbery embodiments such as those made from thermoplastic elastomers. Examples of synthetic yarns include nylon, polyester, and spandex (polyurethane) yarns. Embodiments may also comprise stretch materials and designs, mesh fabrics, recycled and flexible materials, cottons, polyester, rayon, spandex, fleece, leathers and synthetic leathers, rubbers, plastics, woven fabrics, non-woven fabrics, cloths, LYCRA, a vinyl material, a neoprene material, a fleece material, or combinations thereof.

The thickness of the dorsal and palmar segments can generally begin anywhere from 0.002 inches to 0.040 inches or more as are standard sports gloves, for example, and can depend on several factors such as comfort and durability preferences. Some embodiments may offer more durable material for the dorsal surface thus requiring an even thicker dorsal segment.

Construction of the present invention may be accomplished by any standard methods, such as, for example, by designing the dorsal and palm sections to meet along a conjoining lateral edge to define a pocket for receiving the eminence of a user's hand. Other standard methods of construction could certainly be used, of course.

One sport that will clearly benefit from the present invention is Golf. The present invention will meet an unmet need by significantly and substantially improving prior art gloves for the weak hand. Currently, only full-fingered gloves are used by golfers. Prior art therefore does not allow a golfer to take complete advantage of his/her preferred grip by allowing for skin contact between both hands and thereby maximizing hand coordination throughout the golf swing.

One embodiment that would improve prior art comprises a glove that covers essentially all of the weak-hand's thumb, middle, ring and pinkie fingers, while leaving the forefinger completely uncovered.

Using embodiments of the present invention now allow a user playing Golf, for example, to place their covered thumb, middle finger, ring finger and pinkie finger on the golf club, and increase the grip by the glove embodiment, while being able to maintain maximum tactile abilities by leaving uncovered the user's weak hand forefinger. This and other embodiments now allow far greater feel and coordination lost with prior art especially when gripping a golf club using the conventional interlocking grip. The interlocked fingers now allow for far better feedback because both interlocked fingers are now uncovered, making it easier to adjust a golf swing. Users who prefer this embodiment will greatly benefit from maximum feel between the completely uncovered interlocked fingers of both hands.

This and other features now essentially make the sports glove more operable, novel and significantly superior to prior art, especially for those playing the sport of Golf using the popular interlocking grip.

Additionally, a grip enhancing means may be provided along the palmar surface of the glove to further increase grip capabilities, if preferred. For example the grip-enhancing means may comprise a plurality of projections formed from a skid resistant material, such as neoprene, PVC, rubber or the like. The projections can form a pattern on the palmar surface. Preferably, the high friction surface includes interstices or spaces between projections to allow for necessary flexibility. Preferably, the projections have an average height of about 700 micrometers. Other similar embodiments can have uniform heights of say, 600 micrometers to three or four millimeters.

Another preferred glove embodiment that will provide superior advantages over prior art in the sport of Golf would only partially cover the user's forefinger while essentially enclosing the thumb, middle, ring and pinkie fingers.

As previously mentioned, one very popular grip is called the interlocking grip. When you use this grip, the forefinger of the golfer's weak-hand is placed over his dominant hand and is interlocked with the dominant hand's pinkie finger. With this grip, clearly the role of the weak-hand's forefinger has less to do with grip and more with coordination and feel on the strong-hand, to more effectively control the golf swing and to provide greater golf swing consistency. There is, therefore, no real need to cover all of the weak-hand's Forefinger, and covering the forefinger actually diminishes said forefinger's sensitivities. Embodiments of the present invention would offer significant improvements to prior art.

This embodiment could comprise a glove that covers essentially all of the weak-hands thumb, middle, ring and pinkie fingers, while leaving the forefinger's fingertips uncovered. Specifically, for example, a forefinger digital segment would exist whereby all of the proximal and middle phalanges are completely covered. In addition, most of the distal phalanx would be uncovered, say about sixty percent, such that all of the forefinger's fingernail is completely uncovered, and extending around the palmar portion of the forefinger segment.

Users who prefer this embodiment will greatly benefit from significantly increased feel between the uncovered portions of the interlocked fingers of both hands, while still providing some grip-enhancing support along the forefinger's proximal phalanx, where the forefinger segment often touches the golf club during a golf swing.

A grip enhancing means can of course be formed on this and other embodiments. For example, a grip enhancing means can also be formed on any finger stalls or along the metacarpophalangeal joints if preferred, thus providing added grip capabilities along the area where the club is gripped. For the same reasons aforementioned, this embodiment would significantly assist golfers using any of the interlocking, for example. The grip enhancing means may comprise of stripes, for example, projecting out about 600 micrometers.

Among the benefits of the present invention include: the ability to offer greater golf consistency and accuracy by solving this previously unsolvable problem in prior art; a far more successfully coordinated golf swing; and heightened feel capabilities for better feedback if the golf club inappropriately moves during a golf swing. Using this embodiment will allow a user to maximize feel with both hands.

This embodiment may also comprise of a wrist securement opening means to secure the glove to the user's hand. The opening means may be, for example, an elastic means or a flap which mechanically engages a flap capture mechanism (e.g., a synthetic hook and loop fastening interface which adheres when pressed together, commonly using VELCRO). The wrist portion opening means may alternatively comprise an elastomeric band fixed around then wrist aperture. Embodiments may also have combinations of both a flap capture mechanism and an elastomeric band. The wrist portion may be formed integral with the glove or may be attached to the glove by standard methods, such as by sewing.

This and other embodiments may be in the form of a standard synthetic leather golf glove, with the dorsal and palmar surface areas essentially covering all five metacarpals, with the exception of a slit along the dorsal surface which allows the golfer to insert the hand into the glove, and micro recesses along portions of the glove to allow for ventilation.

Embodiments may also offer an additional significant feature to greatly enhance golf swing performance and hand swing coordination. One modification to the embodiment just mentioned above, may, in addition to having heightened tactile sensitivities along the weak hand's forefinger, may also offer increased tactile sensitivities along the weak hand's middle finger. This heightened tactile sensitivity may be accomplished by having an aperture along the weak hand's middle finger digital segment. The aperture on the middle finger segment could be located to leave uncovered about the top half of the proximal phalanx, for example, thus creating one rather large aperture. This finger configuration will allow a golfer to increase their overall control of a golf swing.

When the golfer uses the interlocking grip and places the Pinkie finger of his/her dominant hand around and between the uncovered Forefinger and covered Middle finger of his weak-hand, the coordination from the added feel between the two hands will be enhanced with this embodiment. As the strong hand's pinkie finger wraps around and embraces the covered weak hand's covered forefinger's proximal phalanx, the pinkie finger would abut and also touch the skin of the weak hand's middle finger because of the embodiment's aperture along the middle finger segment.

This embodiment, and others, can allow a golfer to use the interlocking method to provide the usual grip capabilities on the weak hand while now providing significantly superior tactile sensations in coordinating hand movements because of the aperture. By providing this opening along this select area, the user can uniquely increase feel without losing grip capabilities along other portions of the interlocked hands.

The increased sensitivities will provide a user with significantly enhanced capabilities to coordinate a golf swing, to feel if there is even a modest amount of unnecessary movement between both hands, and to more properly adjust his or her next golf swing. Embodiments of the present invention offer these significant improvements thereby solving an unrecognized problem in prior art.

Some embodiments, of course, will not have an aperture along the middle finger segment. These embodiments that are absent of any aperture will be useful and significantly beneficial to those playing the sport of golf, primarily because the unique finger configurations of the glove, as well as because of any grip enhancing means on embodiments.

Additionally, this embodiment can have a palmar and dorsal portion overlaying a portion of the wrist area. For example, the wrist portion can be stitched on the glove and be made of an expandable composition whereby the glove expands when being placed on a hand, and then naturally readjusts to fit snugly around the user's wrists.

Finally, this and other embodiments may also provide a detachable ball marker, such a circular magnetic disc that attaches to a magnet located on the dorsal surface area of the golf glove, for example. The ball marker may be secured by any standard fastening means, such as by magnetism or snap fastening, for example. The back portion of the detachable ball marker as well as the connecting dorsal segment of the glove may both therefore have small magnets. The ball marker may be circular or non-circular in design.

The rest of the hand, front and back, can be essentially covered by the glove.

Clearly, the present invention provides users significant and substantial benefits, including but not limited to significantly improved feedback capabilities, especially when it comes to feeling if a user's hands were misaligned at any time throughout a golf swing.

The benefits of these significant and substantially different physical configurations of the present invention will inevitably create a new method of gripping a golf club. The generally accepted method of swinging a golf club is clearly a result of the limitations of prior art gloves.

The present invention will, for example, allow a user's weak hand to have heightened tactile sensitivities to have a better coordinated and proper golf swing. Once a user begins to swing the golf club, the user can have heightened sensitivities to feel if the hands suddenly are misaligned, for example. The golfer should now have a more stable overall grip, better control and enhanced performance possibilities. This improved method, of gripping and swinging a golf club by having heightened tactile sensitivities on both hands, not just with the dominant hand, will provide a user with greater overall control and consistency in a golf swing.

SUMMARY

Many features can be used in conjunction with each other to uniquely solve problems that have up until now been unsolved.

In general, embodiments of the present invention can generally be used in conjunction with any type of hand task activity and/or sports play. As discussed, embodiments offer an individual with the opportunity to increase overall hand task performance. Maintaining or increasing overall control, for example, can provide many benefits to a user of these, and other embodiments. These and other embodiments:

- offer the ability to grip as well as feel a sports device, such as a golf club
- provide a unique solution for users who desire better grip capabilities only in select areas
- offer a more stabilizing overall grip of a ball or object, by conveying grip-enhancers to select locations of the hand
- provide grip enhancers along the connecting area between the thumb and forefinger
- allow an individual to maintain or increase control of a ball or object along the metacarpophalangeal joints
- permit the ability to use a glove on a weak hand configured to meet the unique needs of a user's preferred golf grip, especially for those using an interlocking grip
- improve performance in hand task execution by providing heightened feel capabilities on a golfer's weak hand
- offer more control capabilities throughout a sports task, a valuable feature when striking a golf club with greater velocity
- allow more hand coordination by adjusting grip-enhancers to match a preferred particular golf swing
- decrease the likelihood of golf slices
- provide superior coordination in a golf swing
- enhance overall control and golf swing stability.
- improve tactile feedback to feel if a user's wrist moved the wrong way
- forward or backward—during a golf swing.
- increase the possibility for squarer golf clubface at impact with the golf ball thereby improving ball contact, trajectory and accuracy.
- allow a user to maintain grip capabilities that a glove generally provides while being able to significantly enhance tactile sensations along the same hand.
- provide a much improved method of playing the sport of Golf by using grip enhancers not just on the weak hand but also on the strong hand as well, without limiting the feel and coordination requirements in a proper golf swing.
- create a more strategically placed moisture management system that is more appropriately suited for golfers who use the interlocking or overlapping grip.
- increase a more unison golf swing by allowing the user to better feel if his or her hands separate during the unhinging process.

These are among the many benefits of the present invention, and are not to be construed as limitations of the benefits nor their legal equivalent.

Although the description of the present invention only discussed two sports, it is understood that individuals playing other sports might benefit as well, such as football.

Furthermore, only some embodiments have been discussed and in no way is intended to limit all the various embodiments and other embodiments that the present invention provides, such as but not limited to, different designs or multicolors or fluorescent colors. Embodiments can of course be used by men and women, boys and girls, professional athletes or amateurs, as well as by those whose dominant hand is the right hand or the left.

BRIEF DESCRIPTIONS OF THE DRAWING

It is expressly understood that the following descriptions and drawings are for illustration purposes only, and in no way are intended to limit the scope of the present invention and its various embodiments. For example, the drawings are of embodiments for the left hand but can easily be created for the right hand.

FIG. 1 is a drawing of the palmar (front) view of an embodiment. The glove completely covers the thumb, middle finger, ring finger and pinkie finger. The glove also has a finger segment that covers the forefinger's proximal phalanx but does not extend to cover the forefinger's middle or distal phalanges.

DETAILED DESCRIPTION OF THE DRAWINGS

It is expressly understood that the drawings are for the purpose of illustration and description only and are not intended as a definition of the limits of the invention.

Figure 1:
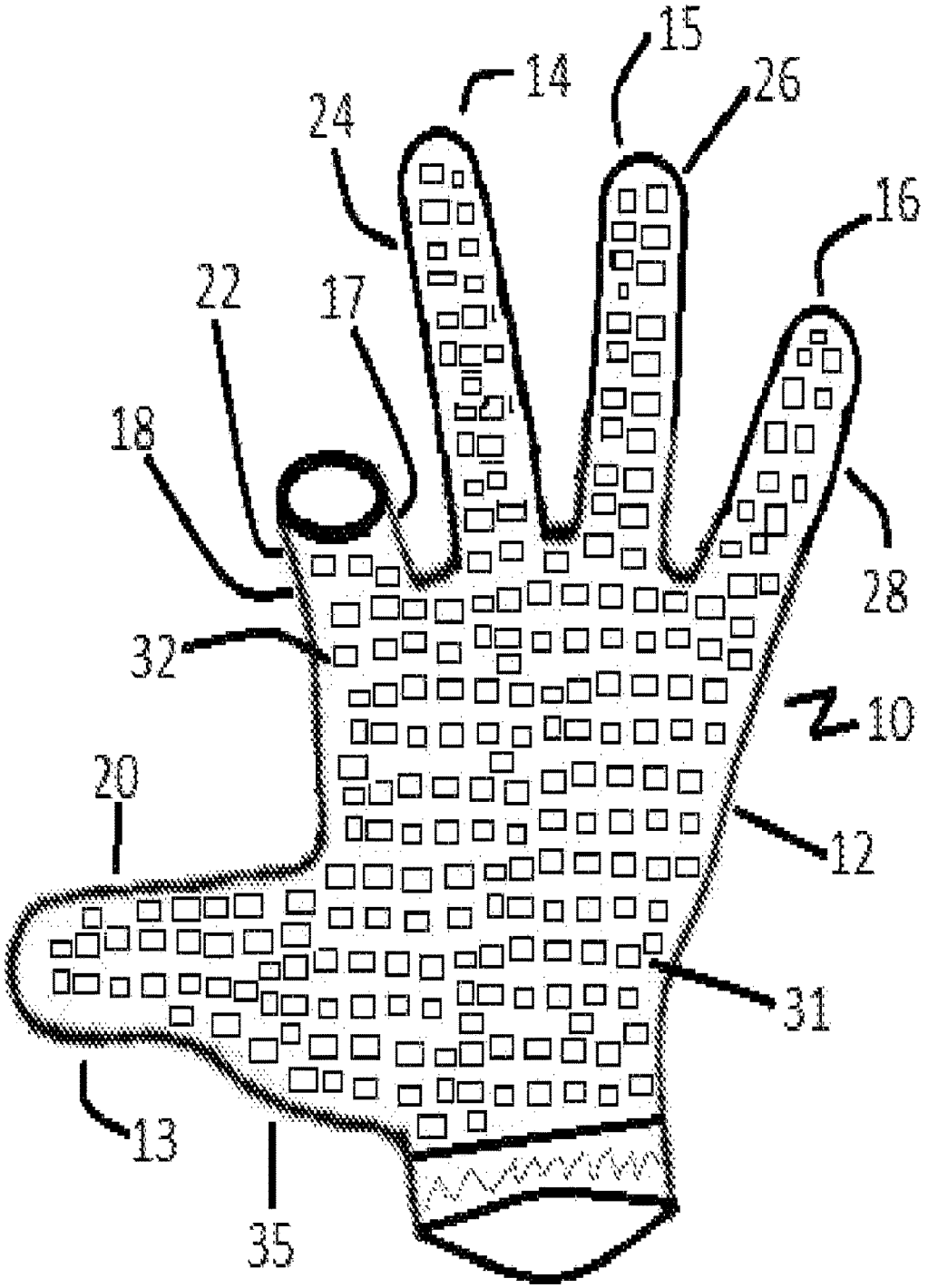
Figure 2:
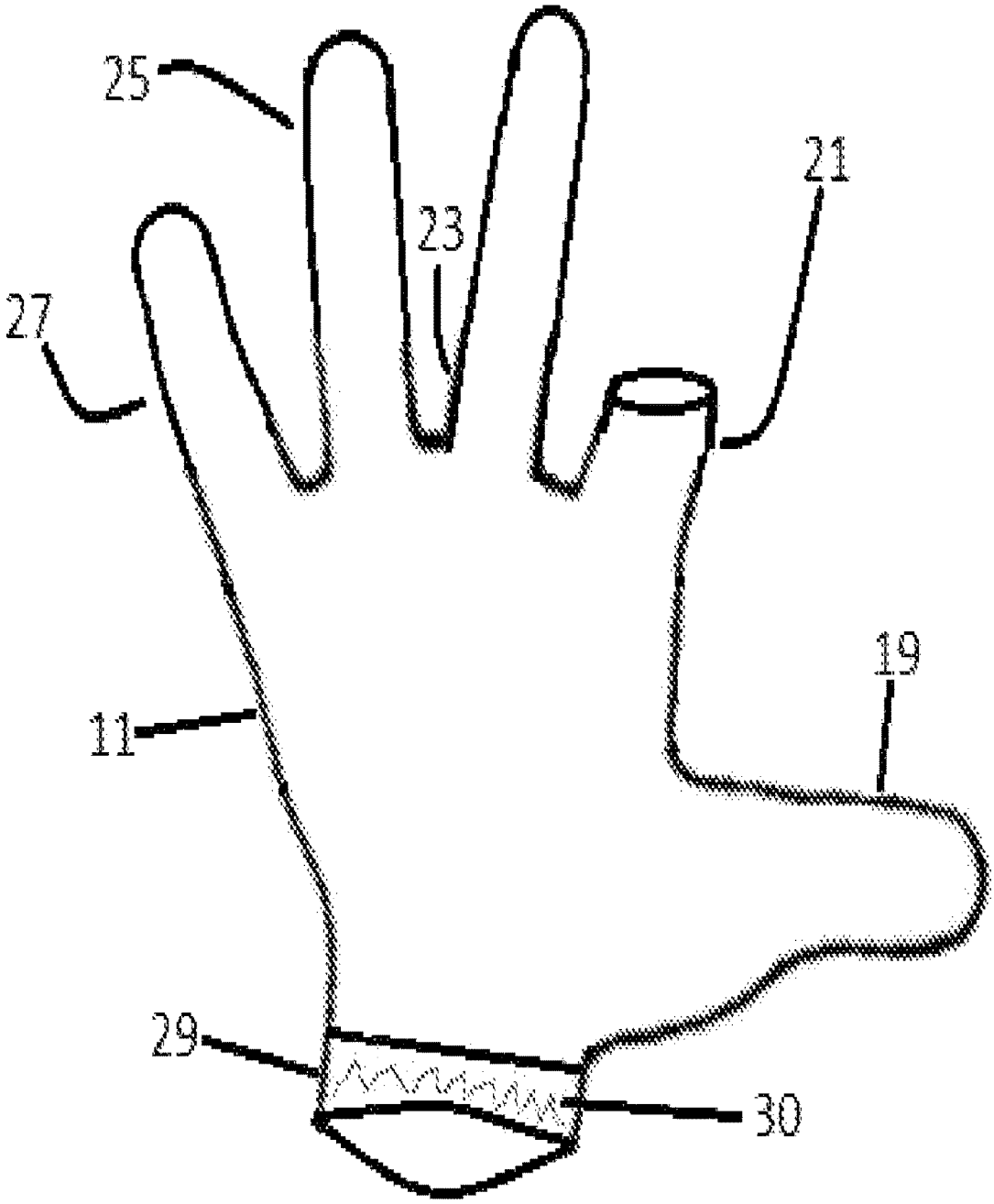
FIG. 2 is a drawing of the embodiment as described in FIG. 1, showing the dorsal (back) view.

Referring now to FIG. 1 and FIG. 2, an embodiment of the present invention is shown and designated as 10. The palmar view of a left-handed glove is drawn in FIG. 1 and the dorsal view of the same glove is drawn in FIG. 2. This partial-fingered embodiment provides a glove having a dorsal portion 11, a palmar portion 12 for overlaying respective back and palm regions of a human hand, said dorsal and palmar portions having distal and proximal ends with a plurality of digital segments (or stalls) projecting from said distal ends. The glove includes a glove body having a back portion covering the back of the hand 11, and a front portion covering the palm or front of the hand 12. The glove body includes finger stalls (or digital segments) and a thumb stall (digital segment) each adapted to receive a finger or thumb, respectively, therein.

In the illustrated embodiment the glove is constructed such that the thumb 13 digital segment encloses said thumb, including enclosing the fingertips. The glove has a middle finger digital segment 14 that encloses the middle finger, including the fingertips, a ring finger digital segment 15 that encloses the ring finger, including the fingertips, and a pinkie finger digital segment 16 that covers the pinkie finger, including the fingertips of a user. In addition, the glove has a forefinger digital segment 17 that covers only the proximal phalanx 18, in its entirety, but does not extend to cover any portion of a user's middle or distal phalanges of the forefinger, therefore defining the forefinger segment's terminal edges.

The palmar section also covers the palm segment overlaying the palm of the hand 12; the dorsal section also covers the back of the hand 11. The glove also has a wrist portion that surrounds the wrist of a user.

The thumb stall 13 is defined by a dorsal portion 19 and a palmar portion 20. The forefinger stall 17 is defined by a dorsal portion 21 and a palmar portion 22. The middle finger stall 14 is defined by a dorsal portion 23 and a palmar portion 24. The ring finger stall 15 is defined by a dorsal portion 25 and a palmar portion 26. The pinkie finger stall 16 is defined by a dorsal portion 27 and a palmar portion 28.

The wrist portion is preferably expansible so as to hold more securely to the user's wrist. Therefore the embodiment also has an expandable opening means 29 at a wrist end 30 adapted to receive the user's hand. The expandable opening means comprises an elastic material along the wrist portion, such as an elastomeric band 29 fixed around the wrist. If desired, the opening means may comprise a strap means at the open end of the glove body for fastening the glove body secure about the wrist area, or a combination thereof. The strap may have two pads of cohesive-adhesive material for releasably securing the strap. The strap as well as this wrist portion may be sewn onto the glove, for example.

This embodiment further shows how the present invention may comprise a grip enhancing means. Although the embodiment now provides a higher coefficient of friction on a golfer's weak hand, one may now further increase grip areas by adding a grip enhancing means on select areas or on the entire palmar surface of the glove.

In the illustrated embodiment, the grip enhancing means comprises a high friction surface 31 formed on the entire palmar surface of the glove 12, including the palmar surfaces of the thumb segment 20 and any existing finger segments 22, 24, 26 and 28. Preferably, the high friction surface is formed from a PVC material, a nitrile material, a latex material, or a rubber material (as shown) 35. The surface may include a depression or projection pattern formed from the high friction material. Formed on the illustrated material is a plurality of square-like projections 32 that are applied to the entire palmar surface area by any standard means, as aforementioned. These square-like projections preferably are spaced apart to allow for added grip and flexibility. The rubber palmar surface can then be conjoined to the dorsal surface, thus creating the glove. Preferably, the heights of the embodiment's projections are such that the gap formed by the projections allow for some movement of the palmar surfaces thereby increasing the grip capabilities of the user. The height can generally begin at about one hundred micrometers to several millimeters or more. For example, these projections are about two hundred micrometers in height, about two millimeters in width and four millimeters in length.

The dorsal surface may comprise of a different material than the palmar surface, such as a more durable fabric, but would preferably also be rather flexible. If the dorsal surface is comprised of more durable fabrics, such as synthetic leather, then some added elasticity capabilities may be also preferable, though not required, on select area of the dorsal surface, in particular around the metacarpophalangeal joints. For example, the dorsal surface may comprise of an aperture on the forefinger's metacarpophalangeal joint, the middle finger's metacarpophalangeal joint, the ring finger's metacarpophalangeal joint, and on the pinkie finger's metacarpophalangeal joint. Alternatively, embodiments may simply comprise of a more elastic material, such as any of those aforementioned such as spandex, on the dorsal surface overlaying said metacarpophalangeal joints, or seams or slits, while the rest of the dorsal surface is comprised of a more durable material. The elastic material could be stitched onto those areas, and therefore replacing the more durable materials along those select areas.

The palmar and dorsal surfaces, and any wrist portions, may then be conjoined on any finger and thumb portions, dorsal and palm portions and a wrist portion using any standard methods, such as by stitching, thus defining a pocket for receiving a user's hand.

As aforementioned, this embodiment provides users with several benefits, in multiple sports. For example, those playing the sport of Golf may use this embodiment on their weak hand thereby allowing the golfer significantly more grip capabilities while simultaneously being able to have heightened tactile abilities at the same time on key areas of the interlocked—and partially uncovered—forefinger.

By way of example, baseball pitchers may also find this embodiment beneficial over their strong (pitching) hand primarily because it offers grip enhancing capabilities on the fingertips on select digital segments while allowing the pitcher to maintain heightened feel by simultaneously providing the pitcher with the ability to touch the baseball with the skin of his or her forefinger.

Figure 3:
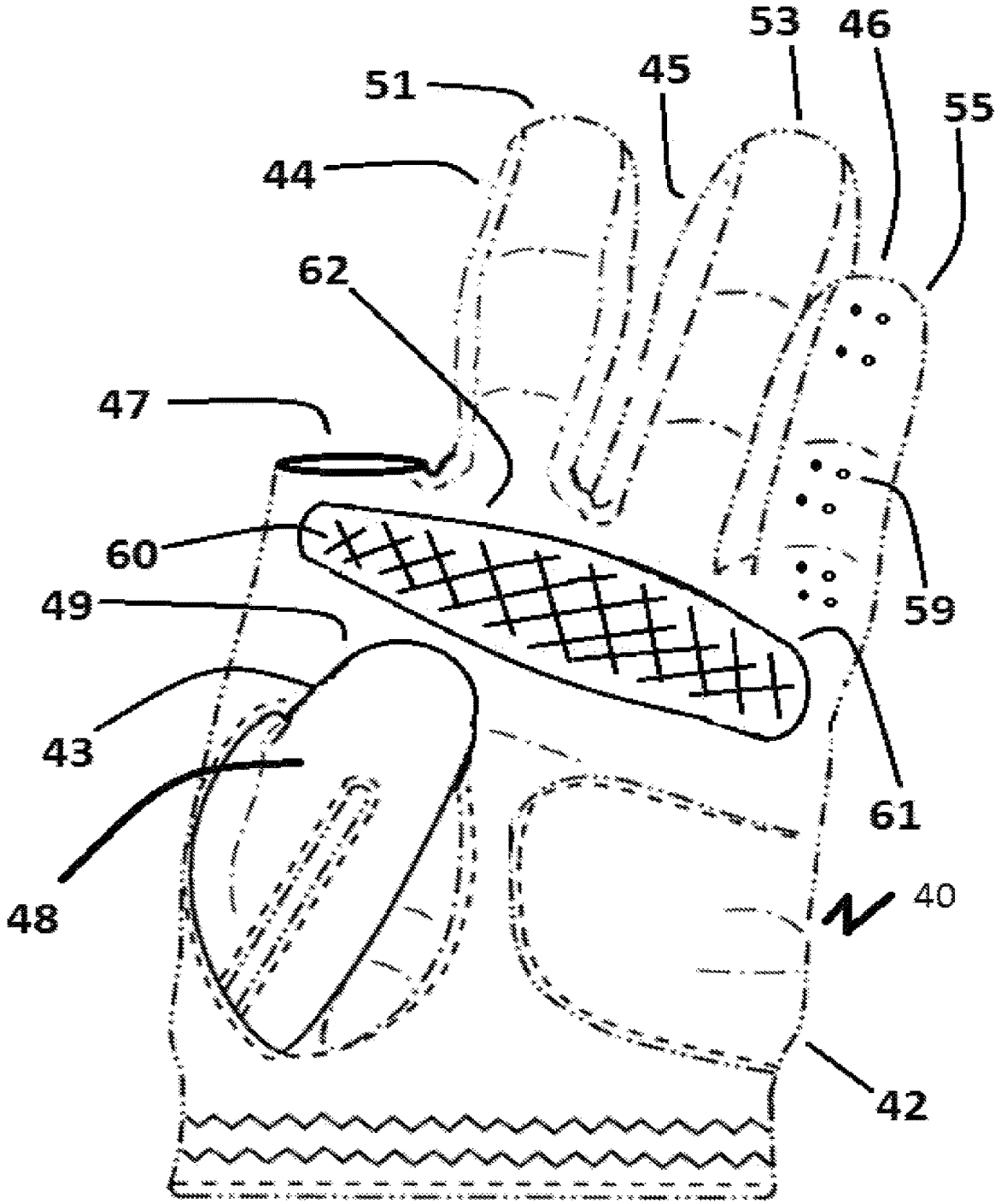
FIG. 3 is a drawing of the palmar view of a second embodiment.
Figure 4:
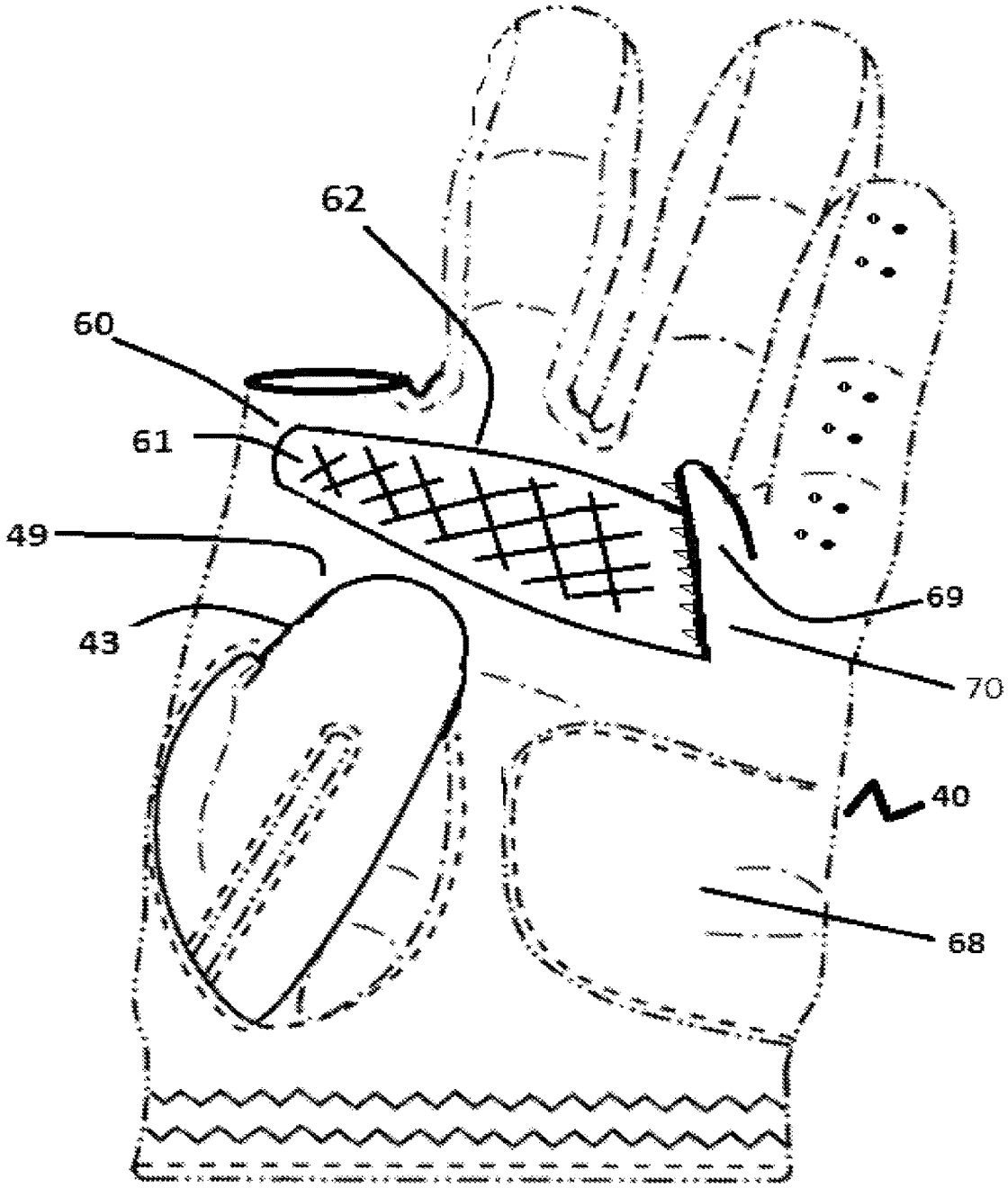
FIG. 4 shows the top and bottom view of a panel which creates a higher friction surface on an embodiment, as shown in FIG. 3.
Figure 5:
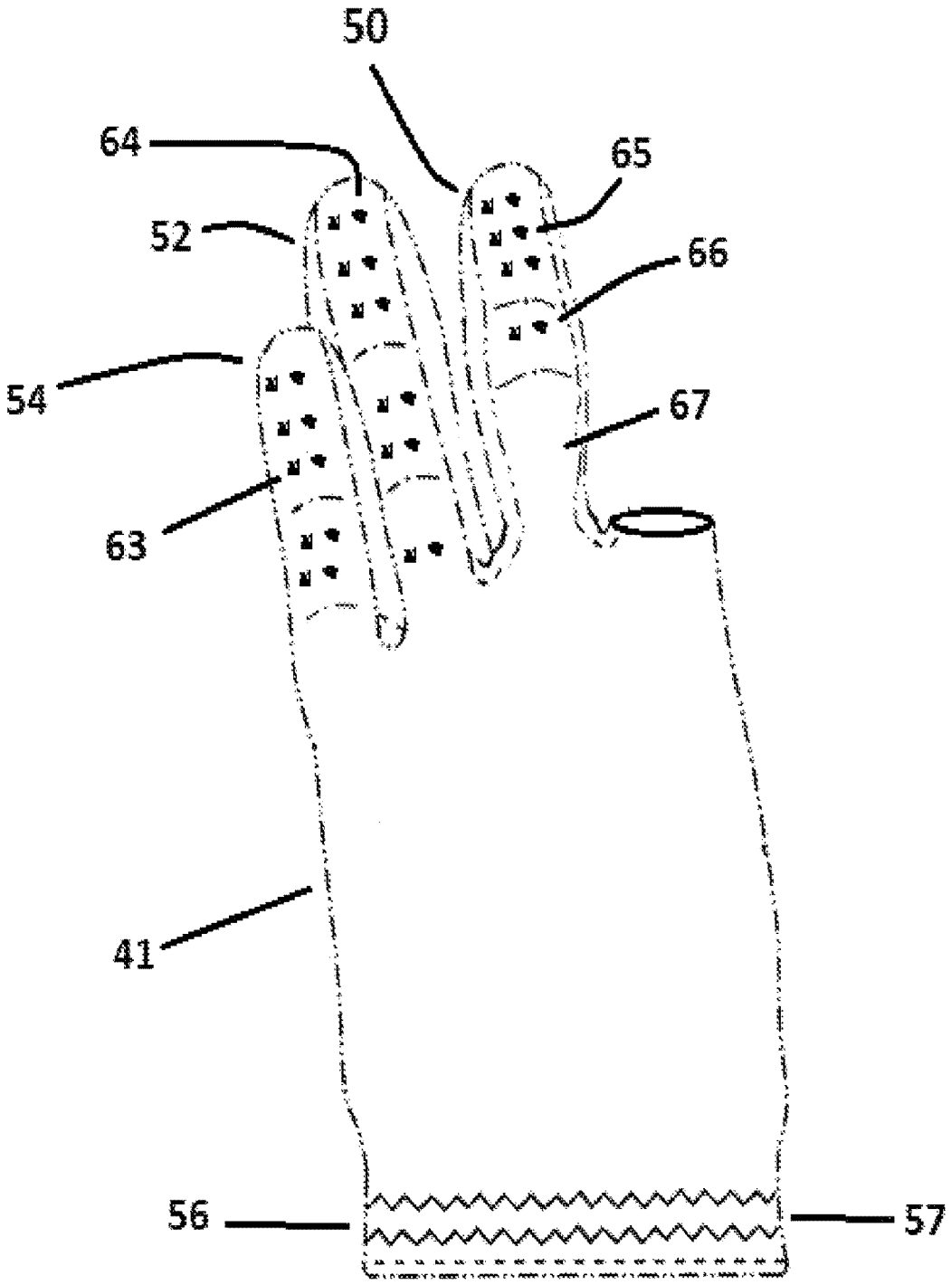
FIG. 5 is a drawing of the embodiment as described in FIG. 3, showing the dorsal view.

Referring now to FIG. 3, FIG. 4 and FIG. 5, a second embodiment of the athletic glove of the present invention is shown and designated as 40. The palmar (front) view of a left-handed glove is drawn in FIG. 3 and the dorsal (back) view of the same glove is drawn in FIG. 5. This partial-fingered embodiment provides a glove having a dorsal portion 41 and a palmar portion 42 for overlaying respective back and palm regions of a human hand, said dorsal and palmar portions having distal and proximal ends with a plurality of digital segments (or stalls) projecting from said distal ends. The glove includes a glove body having a back portion covering the dorsal surface of the hand 41, and a front portion covering essentially the entire palm surface of the hand 42. The glove body includes finger segments and a thumb segment each adapted to receive a finger or thumb, respectively, therein.

In the illustrated embodiment, the glove is constructed such that the thumb 43 digital segment encloses said thumb, including enclosing the fingertips. The glove also has a middle finger digital segment 44 that covers the middle finger, including the fingertips, a ring finger digital segment 45 that covers the ring finger, including the fingertips, and a pinkie finger digital segment 46 that covers the pinkie finger, including the fingertips of a user. This embodiment does not have a forefinger digital segment 47 therefore a user's forefinger is completely uncovered.

The palmar surface of this glove embodiment therefore essentially covers the rest of the front of the hand, including the entire palm of the hand 42; the dorsal section covers most of the rest of the back of the hand 41, allowing for possible micro-recesses for ventilation.

The thumb stall 43 is defined by a dorsal portion 48 and palmar portion 49. The middle finger stall 44 is defined by a dorsal portion 50 and a palmar portion 51. The ring finger stall 45 is defined by a dorsal portion 52 and a palmar portion 53. The pinkie finger stall 46 is defined by a dorsal portion 54 and a palmar portion 55. There is no forefinger stall so there is no dorsal or palmar portion defining the forefinger stall.

The glove also has an expandable opening means at a wrist end portion 56 adapted to receive the user's hand. The expandable opening means comprises an expandable opening means comprised of an elastic material such as an elastomeric band 57 fixed around the wrist to expand and contract for easier glove application onto a hand. The wrist portion is preferably expansible so as to hold more securely around the user's wrist. As with other embodiments, the glove may alternatively, or additionally, have a strap means at the open end of the glove body for fastening the glove body secure about the wrist area. The strap means may be unitary with the glove body and may include VELCRO fasteners, buttons, and the like or other suitable closure means thereon.

This embodiment further shows how the present invention may also comprise a grip enhancing means. Although the embodiment now provides a higher coefficient of friction on a golfer's weak hand hand, one may now further increase grip areas by adding a grip enhancing means on select areas.

The pinkie finger digital segment 46 of this embodiment has a grip enhancing means, in the form of PVC dots 59, on at least a portion of the palmar pinkie finger segment. The PVC dots preferably project out at least about seven hundred micrometers. The PVC dots located on the palmar section of the pinkie finger stall are throughout said stall. Similar embodiments may have a grip enhancing means also along the thumb segment, or combinations thereof, to maximize grip abilities on the fingertips of the thumb and pinkie finger. This will allow for greater golf club grip retention throughout the golf swing including during impact with the golf ball.

The grip enhancing means of the present invention may be integral to the glove or may be affixed to the glove using any standard methods. For example, this embodiment comprises grip enhancing means that is integral to the glove pinkie finger stall, using any standard method known in the art. For example, the PVC dots can be imparted by any standard methods, such as, for example, by molding. The heights of the PVC dots in this embodiment are all the same height, and are in rows. Other embodiments could of course offer different heights, non-uniform heights, and have a more random pattern on the top surface.

The locations of the grip enhancing means may vary on several factors of course, such as personal preference and preferred degree of enhanced grip. This added grip configuration will be useful especially to golfers and baseball pitchers for reasons described herein. Other grip enhancing configurations and locations may of course be preferred.

The embodiment's grip enhancing means can also comprise of a high friction surface, such as creating crisscross projections 60, to the glove area beginning at the digital creases and extending to overlay the forefinger metacarpophalangeal joint, the middle finger metacarpophalangeal joint, the ring finger metacarpophalangeal joint, and the pinkie finger metacarpophalangeal joint. The grip enhancing means portion overlaying the pinkie finger metacarpophalangeal joint may preferably not extend over the upper-palmar crease, however, to provide optimal flexibility, although some embodiments may extend to cover the entire pinkie joint.

The grip enhancing means can also comprise of a high friction surface by applying a non-slip coating, such as a latex, a nitrile or PVC coating, along described locations of this embodiment. The coating could of course also be applied to the entire palmar portion of the glove.

This grip enhancing means may be affixed to the glove. In general, as aforementioned, a grip enhancing means may be either formed on or applied to any palmar portion, such as the palm or any thumb or any existing finger stalls, using any standard methods. The embodiment's gripping means can comprise of a high friction surface, such as creating crisscross grooves 60 that are depressions onto a rubber surface panel 61, for example, then attaching said panel onto a portion of the gloves palmar surface area. The panel is attached to the palmar surface of the glove by any standard methods of attachment, such as by adhesion or stitching.

The panel may be is attached to the glove area, for example, beginning at the digital creases and extending to overlay the forefinger metacarpophalangeal joint, the middle finger metacarpophalangeal joint, the ring finger metacarpophalangeal joint, and the pinkie finger metacarpophalangeal joint, 62. The panel portion overlaying the pinkie finger metacarpophalangeal preferably does not extend over the upper-palmar crease, however, to provide optimal flexibility. This form of attachment may additionally be used to affix a grip-enhancing means over the thumb stall, any existing finger stalls and/or along the area between the forefinger and thumb stalls, in part or in their entirety.

The panel may generally be comprised of any flexible material, for example, a plastic material having a top surface comprising the grip enhancing area formed by a plurality of depressions, such as, for example, ridges.

A preferred depth of the crisscross depressions would be such that the gap formed by the depressions would allow for some movement of the newly formed top surface edges thereby increasing the grip capabilities of the user. This grip enhancing means could have a preferred depth beginning about six hundred micrometers, and can be imparted by, for example, embossing or standard mechanical treatments.

Alternatively, this grip-enhancing means may be attached, affixed or otherwise placed to select areas 62 of the glove by standard methods and forms of attachment such as by creating a textured surface on a silicone-based layer and then hot melting said silicone surface onto the palmar portion of the glove, thus providing a high friction surface on the embodiment. The panel could also be bonded to, and become a part of the palmar portion of the glove, by any other standard method.

It will be apparent to one of ordinary skill in the art that many other implementations of creating and applying panels to sports gloves are possible.

The grip enhancing surface would provide an effective coefficient of friction, preferably of at least a Shore A Durometer of two or greater.

The locations of the grip enhancing means may vary on several factors of course, such as personal preference and preferred degree of enhanced grip. Additionally, the depressed designs may vary, such as being in the form of non-linear or crisscross lines, for example. Finally, the depths may vary as well.

Figure 10:
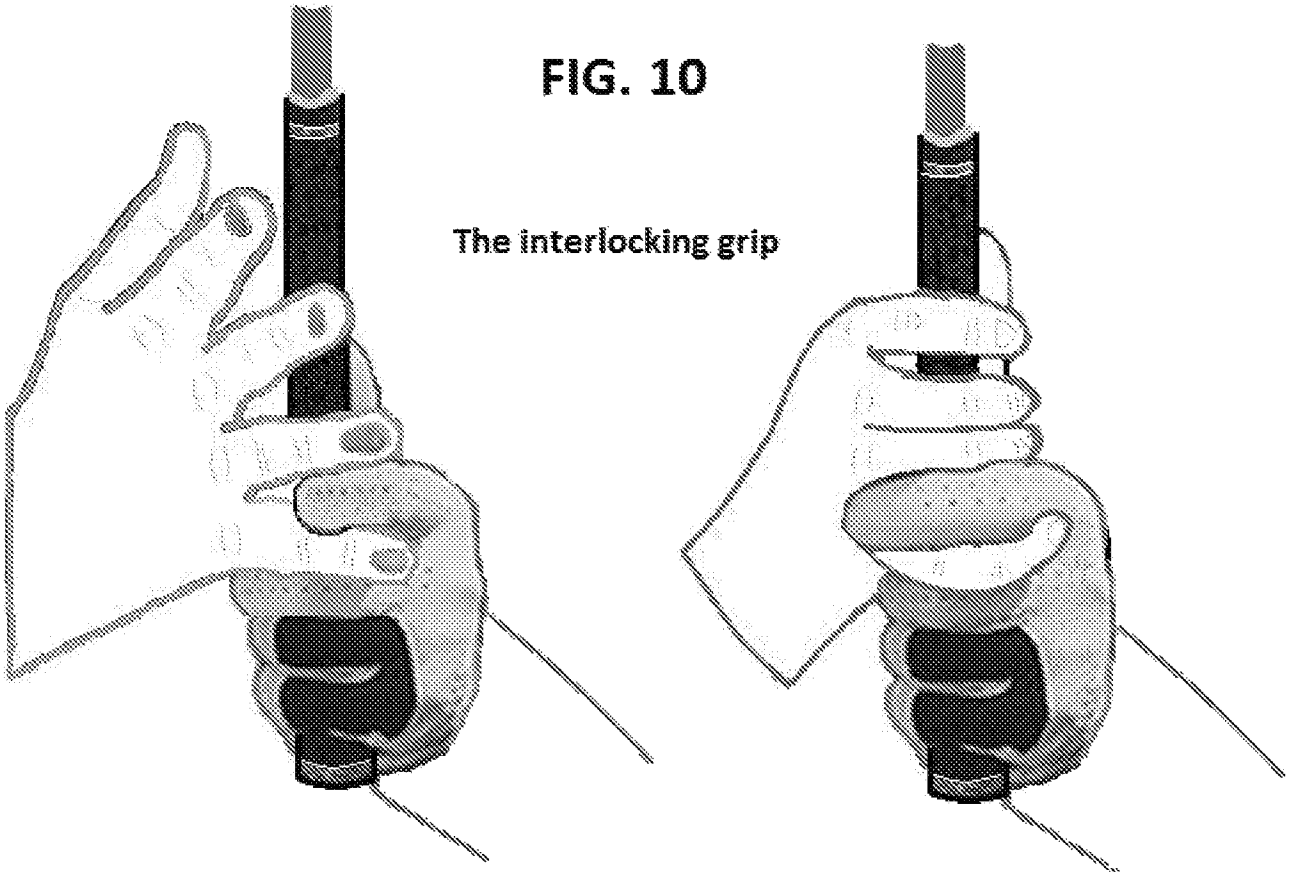
FIG. 10 shows a typical interlocking grip using a conventional prior art glove.

A plurality of micro recesses of about 0.120 millimeters in diameter may be randomly disposed about the front, back and finger and thumb stalls of the glove, thereby providing added comfort and more ventilation. The illustrated embodiment has micro recesses along and throughout the pinkie finger segment 63 and ring finger segment 64. Additionally, there are micro recesses along only the distal 65 and middle phalanges 66 of the middle finger segment. As important aspect of this embodiment is that there are no micro recesses along the proximal phalanx 67 of the middle finger. When a user of this embodiment grips a golf club using the interlocking grip, the strong hand's pinkie finger interlocks with the completely uncovered forefinger thereby providing heightened tactile sensitivities throughout the interlocked fingers. However, as can be seen in FIG. 10, the strong hand's pinkie finger also comes into contact with the weak hand's middle finger segment—specifically with the middle finger's proximal phalanx. Providing micro-recesses along the middle finger's proximal phalanx would therefore be counterproductive because the golfer needs a relatively stable contact between the middle finger and the strong hand's pinkie finger. Therefore, this embodiment would also solve an unrecognized configuration problem with prior art.

As aforementioned, the present invention, including this embodiment may be constructed using standard materials and methods of construction known in the art of making sports gloves. For example, construction of this embodiment may be accomplished by standard methods, such as, by designing the dorsal and palmar sections to meet along a conjoining lateral edge to define a pocket for receiving the eminence of a user's hand. Said dorsal and palmar sections could be conjoined by sewing, for example.

This embodiment further shows how the present invention may comprise of essentially the same materials to construct both the palmar and dorsal surface. This particular glove can be made of a polyester and cotton blend for superior comfort, say about seventy percent polyester. The polyester thread, for example, could be spun with the cotton yarns to produce the composite. Other materials that could comprise these glove embodiments include, but are not limited to woven materials that include natural, synthetic or blends of natural and synthetic yarns, flexible plastics, and thermoextruded or thermoset rubbery embodiments including those made from thermoplastic elastomers. Examples of synthetic yarns include nylon, polyester, and spandex (polyurethane) yarns, and LYCRA. Alternatively, the embodiment may simply comprise of standard synthetic leather and lycra.

Additionally, embodiments such as this one, may be completely coated with a with a water repellant substance, such as a synthetic resin 68 on the palmar surface or throughout the entire glove.

The benefits of this configuration allows a user to have maximum retention of tactile sensation along the weak hand's forefinger, allowing the skin of said forefinger to touch not only the dominant hand's pinkie finger, but also the actual golf club, along the forefinger's uncovered proximal phalanx. The uncovered forefinger portion is allow the user to maximize hand coordination, for example, crucial in completing a successful golf swing. This unique offering will significantly increase a user's ability to control a golf club and also therefore a golf swing and golf ball.

Referring now specifically to FIG. 4, what is shown is the top (front) and bottom (back) portions of a panel which creates a higher friction surface on an embodiment, as shown in FIG. 3. Specifically, shown is a panel overlaying much of the metacarpophalangeal joints of the forefinger, middle finger, ring finger, and pinkie finger stalls 62.

In general, as aforementioned, a grip enhancing means may be either formed on or applied to any palmar portion, such as the palm or any thumb or any existing finger stalls, using any standard methods.

This embodiment shows a gripping means comprising of a high friction surface, such as creating crisscross grooves 60 that are projections onto a rubber surface panel 61, for example, then attaching said panel onto a portion of the gloves palmar surface area. The bottom portion of the panel 69 is attached to the palmar surface of the glove by any standard methods of attachment, such as by an adhesive 70 or stitching.

Figure 6:
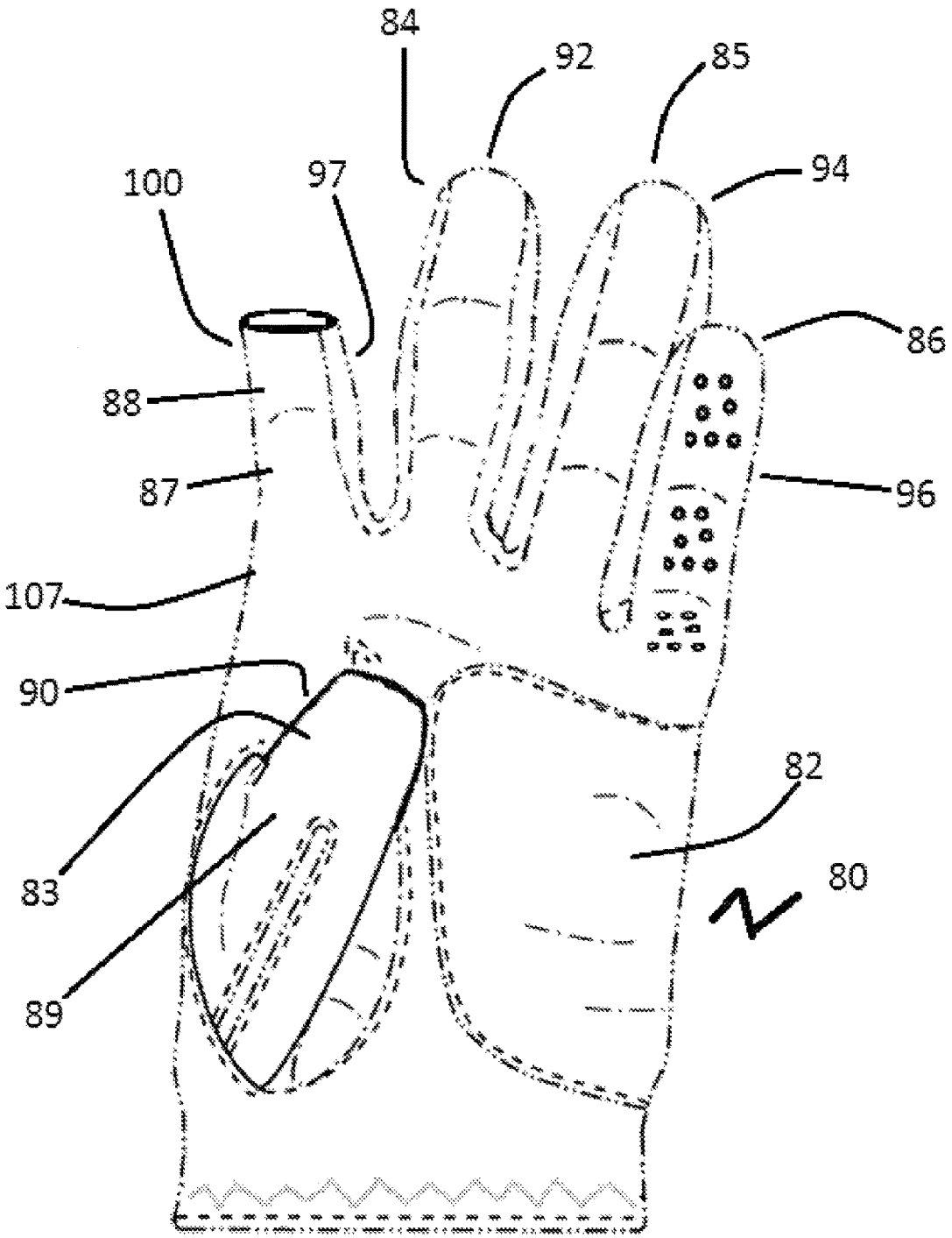
FIG. 6 is a drawing of the palmar view of a third embodiment, shown as a partial-fingered glove. The glove has a forefinger segment that covers the forefinger's proximal and middle phalanges but does not extend to cover the forefinger's distal phalanx.
Figure 7:
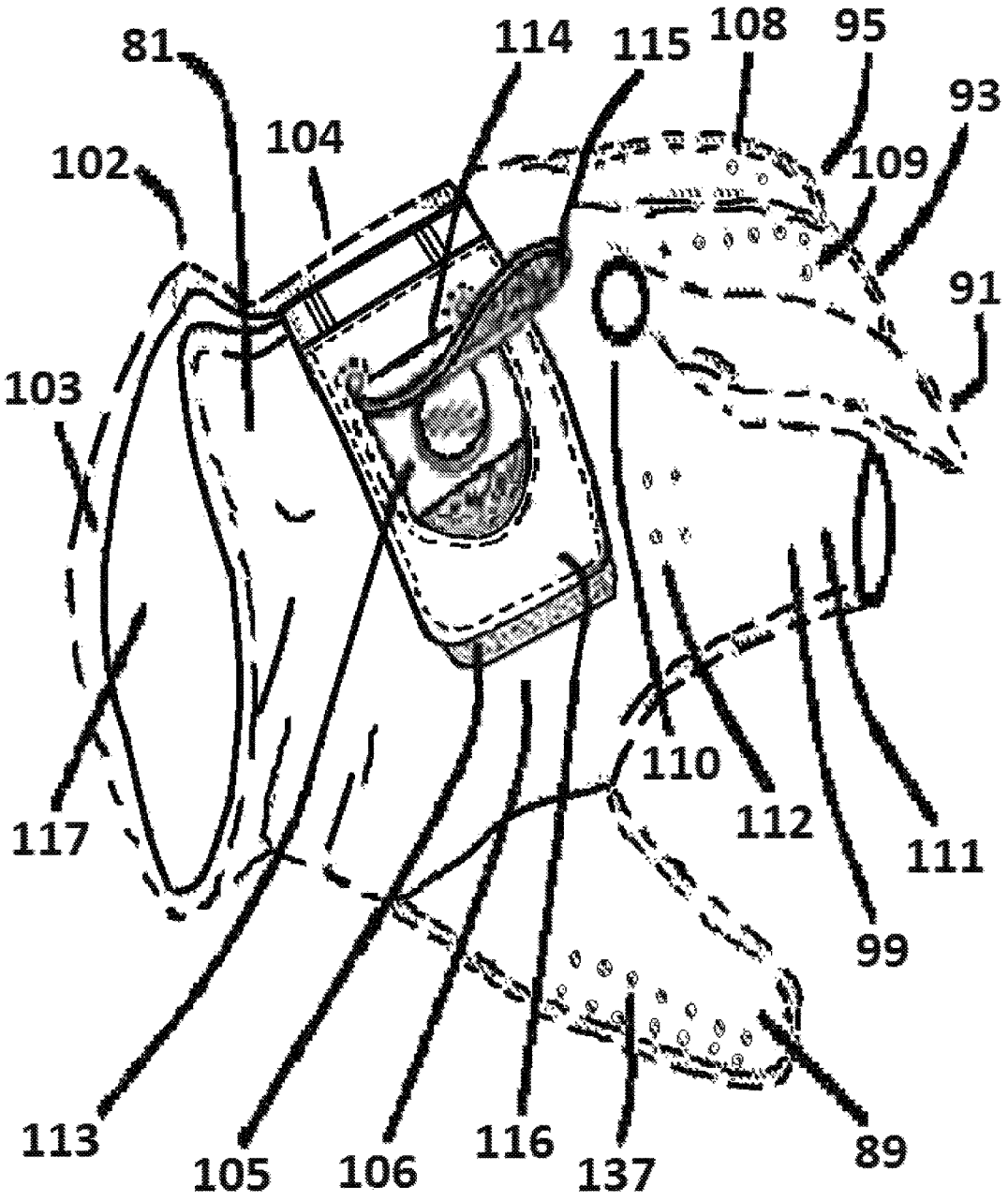
FIG. 7 is a drawing of the embodiment as described in FIG. 6, dorsal view.

Referring now to FIG. 6 and FIG. 7, an athletic glove of the present invention is shown and designated as 80. The palmar (front) view of a left-handed glove is drawn in FIG. 6 and the dorsal (back) view of the same glove is drawn in FIG. 7. This partial-fingered embodiment provides a glove having a dorsal portion 81, a palmar portion 82 for overlaying respective back and palm regions of a human hand, said dorsal and palmar portions having distal and proximal ends with a plurality of digital segments (or stalls) projecting from said distal ends. The glove includes a glove body having a back portion covering the back of the hand 81, and a front portion covering the palm or front of the hand 82. The glove body includes finger stalls and a thumb stall each adapted to receive a finger or thumb, respectively, therein.

In the illustrated embodiment, the glove is constructed such that the thumb segment 83, middle finger segment 84, ring finger segment 85 and pinkie digital segment 86 enclose said thumb, middle finger, ring finger, and pinkie fingers including enclosing the fingertips, respectively. The glove also has a forefinger segment that covers the forefinger's proximal 87 and middle phalanges 88 but does not extend to cover the entire forefinger's distal phalanx; a user's forefinger's fingertips are therefore exposed.

The palmar section covers the entire palm of the hand 82 and the dorsal section covers the back of the hand 81. The glove also has a wrist portion that surrounds the wrist of a user.

The thumb stall 83 is defined by a dorsal portion 89 and a palmar portion 90. The middle finger stall 84 is defined by a dorsal portion 91 and a palmar portion 92. The ring finger stall 85 is defined by a dorsal portion 93 and a palmar portion 94. The pinkie finger stall 86 is defined by a dorsal portion 95 and a palmar portion 96. The forefinger stall 97 is defined by a dorsal portion 99 and a palmar portion 100.

The wrist portion is preferably expansible so as to hold more securely to the user's wrist. Therefore the embodiment also has an expandable opening means at a wrist end 102 adapted to receive the user's hand. The expandable opening means comprises an elastic material along the wrist portion, such as an elastomeric band 103 fixed around throughout the wrist. In addition, the opening means comprises a strap means 104 at the open end of the glove body for fastening the glove body secure about the wrist area. The strap means may be unitary with the glove body and may include VELCRO fasteners 105, 106, buttons, and the like or other suitable closure means thereon.

This embodiment further shows how the present invention may comprise a grip enhancing means. Although the glove now provides a higher coefficient of friction on a golfer's weak hand, for example, one may now further increase grip capabilities by adding a grip enhancing means along the palmar surface of the glove.

The grip enhancing means can comprise of a high friction surface by applying a non-slip coating, such as a latex, a nitrile 107 or PVC coating, along described locations of this embodiment, such as on the forefinger's metacarpophalangeal joint segment. Those using the interlocking grip would find this grip enhanced location especially useful when trying to maintain golf club control along the forefinger's metacarpophalangeal joint, the area just below where the weak hand's forefinger interlocks with the dominant hand's pinkie finger.

The coatings could of course also be applied to the entire palmar portion of the glove.

The grip enhancing surface would provide an effective coefficient of friction, preferably of at least a Shore A Durometer of two or greater.

The locations of the grip enhancing means may vary on several factors of course, such as personal preference and preferred degree of enhanced grip. This added grip configuration will be useful especially to those playing the sport of Golf for reasons described herein. Other grip enhancing configurations and locations may of course be preferred.

Having a gripping enhancing means along these areas will significantly increase a user's ability to control an object such as a golf club by creating an even higher coefficient of friction.

The embodiment's grip enhancing means can also comprise of a high friction surface, such as creating crisscross projections, to the glove area beginning at the digital creases and extending to overlay the forefinger metacarpophalangeal joint, the middle finger metacarpophalangeal joint, the ring finger metacarpophalangeal joint, and the pinkie finger metacarpophalangeal joint. The grip enhancing means portion overlaying the pinkie finger metacarpophalangeal joint preferably does not extend over the upper-palmar crease, however, to provide optimal flexibility. The height of the projections may vary, as aforementioned. These projections are about ½ millimeter in height.

A plurality of micro recesses of about 0.120 millimeters in diameter may be randomly disposed about the front, back and finger and thumb stalls of the glove, thereby providing added comfort and more ventilation. The illustrated embodiment provides micro-recesses throughout the thumb 137 as well as the pinkie finger 108 and ring finger digital segments 109. Additionally, no micro-recesses are provided on the embodiment's middle finger segment but may be provided along said segment's middle or distal phalanx segment, if preferred. An aperture is provided along the middle finger metacarpophalangeal joint segment 110 to allow moisture to escape the middle finger segment without disturbing the interlocked finger area. Finally, no micro-recesses are provided along the forefinger digital segment or order to maintain a more moisture-free forefinger dorsal segment—where the dominant hand's pinkie finger interlocks with the weak hand's forefinger 111. Micro-recesses are provided, however, along the forefinger's metacarpophalangeal joint segment 112, which, along with the uncovered distal phalanx, will provide a more strategic moisture management system for golf glove embodiments.

The embodiment is suitably a substantially conventionally constructed golf glove, modified as aforementioned. This particular glove can be made of a synthetic leather latex coated glove for added durability. Other materials that could comprise these glove embodiments include, but are not limited to woven materials that include natural, synthetic or blends of natural and synthetic yarns, thermoextruded or thermoset rubbery embodiments including those made from thermoplastic elastomers, and cloths. Examples of synthetic yarns include nylon, polyester, and spandex (polyurethane) yarns. Additionally, embodiments such as this one, may be coated with a with a water repellant substance, such as a synthetic resin throughout the entire outer surface of the glove.

As aforementioned, the present invention, including this embodiment may be constructed using standard materials and methods of construction known in the art of making sports gloves. For example, construction of this embodiment may be accomplished by standard methods, such as, by designing the dorsal and palmar sections to meet along a conjoining lateral edge to define a pocket for receiving the eminence of a user's hand. Said dorsal and palmar sections could be conjoined by sewing, for example. One could use any standard method of manufacture and assembly or construction.

The rest of the palmar and dorsal segments could cover the rest of the hand, including the palm.

This embodiment may also comprise a detachable ball marker 113. A ball marker is often used when playing golf. During certain times, such as when reaching the green or when obstructing another player's direct path to the golf hole, the golfer may pick his ball and place a ball marker directly behind the golf ball; the golfer can then pick up the golf ball. The embodiment provides a convenient, detachable ball marker on the glove. The detachable ball marker in this embodiment is a small circular object with a design that points to where the golf ball exactly is located.

The detachable ball marker is secured by any standard fastening means, such as by a compartment, by magnetism or snap fastening, for example. The illustrated embodiment shows a compartment 114 within the strap on the dorsal segment of the glove. The compartment secures the ball marker by VELCRO fasteners 115, 116, but other commonly known fasteners will work just as well. The ball marker may be circular or non-circircular in design.

Additionally, embodiments may offer a liner is fixed to the interior of the glove using methods known in the art, such as stitching. The liner 117 may be integrally formed on the glove. For example, the liner (or sleeve) could be attached to the glove by standard methods, such as by conventional stitching about the perimeter of the dorsal segment, the palmar segment or both.

The lining material (or sleeve) may be comprised of standard lining materials, such as a smooth, flexible knitted fabric. The liner may also comprise of flexible and elastomeric material such as spandex or LYCRA. Other possible materials include a knit of polyester or simply the same material forming the glove. A soft cellular plastic could also be preferred. Additionally, the liner may provide added features to offer warmth and comfort such as by comprising of a fleece material, for example, especially useful when competing in harsher conditions or during extended practices on the golf range, for example.

It will be apparent to one of ordinary skill in the art that many other implementations of liners are possible.

Figure 8:
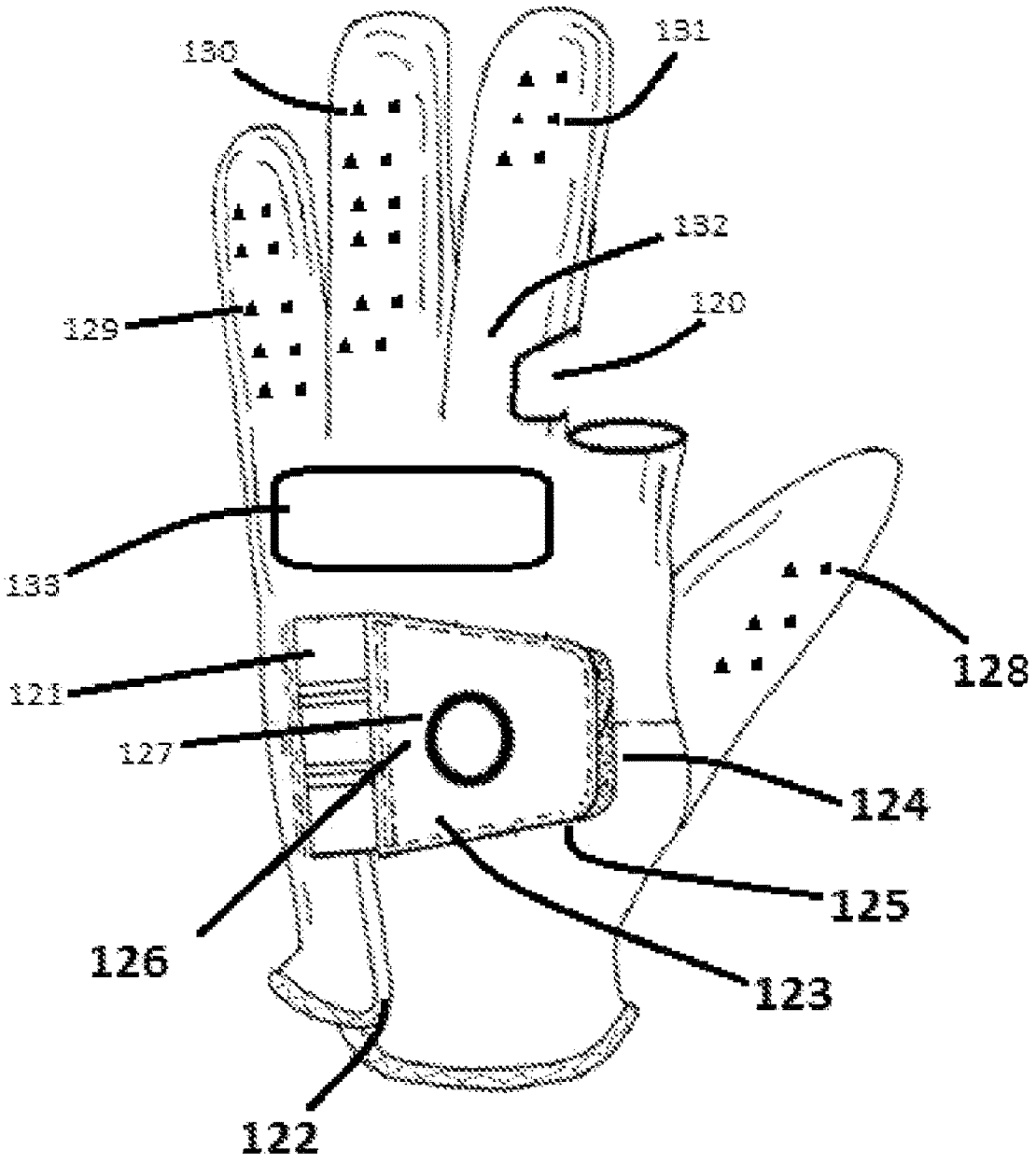
FIG. 8 is an alternative dorsal segment to FIG. 3.

FIG. 8 shows an alternative dorsal segment to FIG. 3. Embodiments may also preferably comprise an aperture 120 along the middle finger segment, such as on any or all of middle finger's proximal phalanx. This embodiment shows an aperture that resides only on the middle finger's proximal phalanx, large enough such that the skin of the middle finger may touch or be touched by the pinkie finger of the dominant hand, for example, while gripping a golf club. As shown, the aperture resides primarily on the dorsal portion extending to the side of said middle finger segment.

In addition, the embodiment also has an expandable opening means 121 at a wrist end 122 adapted to receive the user's hand. The expandable opening means comprises a strap means 123 at the open end of the glove body for fastening the glove body secure about the wrist area. The strap means may be unitary with the glove body and may include VELCRO fasteners 124, 125, buttons, and the like or other suitable closure means thereon. The strap may have two pads of cohesive-adhesive material for releasably securing the strap, for example. The strap as well as the wrist portion may be sewn onto the glove.

This embodiment also comprises a detachable ball marker 126. A ball marker is often used when playing golf. During certain times, such as when reaching the green or when obstructing another player's direct path to the golf hole, the golfer may pick his ball and place a ball marker directly behind the golf ball; the golfer can then pick up the golf ball. The embodiment provides a convenient, detachable ball marker on the glove. The detachable ball marker in this embodiment is a small circular object 126. The detachable ball marker is secured by any standard fastening means, such as by snap fastening 127, by a VELCRO fastening compartment, or by magnetism.

The embodiment also provides micro recesses along the portion of the thumb stall 128, the ring finger segment 130 and pinkie finger segment 129, for ventilation, as is standard. However, while offering micro-recesses along the middle and distal phalanges of the middle finger segment 131 there are no micro recesses along any remaining proximal phalanx segment of the middle finger 132.

The materials forming the illustrated embodiment may comprise those discussed in reference to the present invention. Likewise, any previously discussed methods of construction may be applied to this embodiment. This dorsal segment may be constructed as many standard golf gloves, made primarily of a durable but flexible material, such as synthetic leather, while providing a much more elastic fiber such as spandex 133, along the metacarpophalangeal joints of the four fingers.

As discussed, the partially uncovered fingers as well as the aperture along the middle finger segment offer maximum retention of tactile sensation. The uncovered finger portions allow the user to maximize hand coordination, for example, while the aperture allows the user to maintain maximum feel ability on the golf club—both crucial aspects in completing a successful golf swing. This unique offering will significantly increase the golfer's ability to control a golf club and also therefore a golf swing and golf ball.

Figure 9:
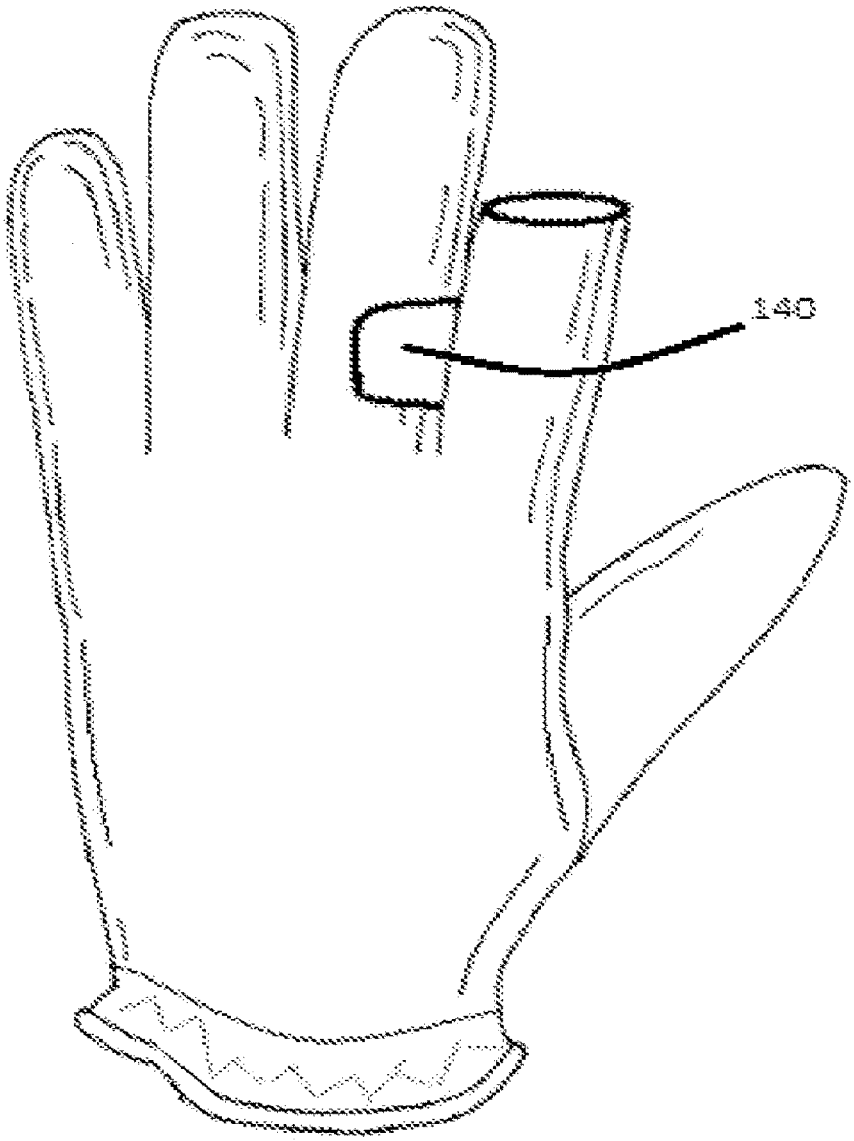
FIG. 9 is an alternative dorsal segment to FIG. 6.

FIG. 9 shows an alternative dorsal segment to FIG. 6. Embodiments may also preferably comprise an aperture 140 along the middle finger, such as on any or all of middle finger's proximal phalanx. This embodiment shows an aperture that resides only on the middle finger's proximal phalanx, thereby defining its terminal edges, but is large enough such that the skin of the middle finger may touch or be touched by the pinkie finger of the dominant hand, for example, while gripping a golf club. As shown, the aperture resides on the dorsal portion of said middle finger proximal phalanx segment leaving uncovered about ninety percent of said dorsal proximal phalanx.

The materials forming the illustrated embodiment may comprise those discussed in reference to the present invention. Likewise, any previously discussed methods of construction may be applied to this embodiment.

FIG. 10 is a drawing of a typical interlocking grip using prior art. As can be seen, the dominant hand's pinkie finger interlocks with the user's weak hand forefinger. The golfer is using a conventional golf glove on the weak hand. The pinkie is clearly exposed to moisture by the micro-recesses provided on the proximal phalanges of the middle finger and forefinger.

I claim:

1. A new sports glove comprising:

a body comprising a palmar portion, a dorsal portion and a distal lateral edge, wherein the palmar portion and the dorsal portion meet at the distal lateral edge;

a plurality of digital segments projecting from the distal lateral edge of the body, the plurality of digital segments comprise a first digital segment, a second digital segment, a third digital segment and a fourth digital segment adapted to entirely cover a pinkie finger, a ring finger, a middle finger and a thumb, respectively, of a wearer without providing a digital segment for a forefinger;

a terminal edge at the distal lateral edge of the body designed to allow the forefinger to extend past the terminal edge to completely expose the forefinger when the glove is worn;

wherein said glove further comprises a separate panel, said panel is affixed to the glove palmar portion surface and is adapted to create a higher coefficient of friction than the surrounding glove palmar portion surface when the glove is worn;

wherein the glove body dorsal portion comprises a water repellant substance;

wherein said panel is positioned to overlay at least the pinkie metacarpophalangeal joint of the wearer's hand, thereby providing enhanced grip along said metacarpophalangeal joint when the glove is worn;

wherein said glove is formed of a polyester and cotton blend, thereby providing a glove with combined comfort and durability;

wherein said panel has a top surface and a bottom surface; and wherein said panel top surface further comprises of a plurality of projections, a plurality of depressions or a non-slip coating, whereby said plurality of projections, plurality of depressions or non-slip coatings are designed to create a higher coefficient of friction along the palmar portion surface than the rest of the palmar portion surface when the glove is worn.

2. The sports glove of claim 1, wherein said glove palmar portion includes multiple textured and untextured areas, each textured area having a coefficient of friction higher than any untextured portion of the glove.

3. The glove of claim 1, wherein the palmar portion comprises a plurality of projections, said plurality of projections are adapted to provide a higher coefficient of friction along the surface area where a golf club is gripped when the glove is worn.

4. The glove of claim 1, wherein said panel is textured and configured to create a Shore A Durometer Coefficient of Friction of approximately two or greater along the glove palmar surface when the glove is worn.

5. The glove of claim 1, wherein said panel is formed of a material having a top surface and a bottom surface;

wherein said panel top surface further comprises of a plurality of projections, whereby said plurality of projections are designed to create a higher coefficient of friction than the material forming said panel;

wherein said heights of the projections are designed to form a gap that provides movement of palmar surfaces relative to a golf club or sports object.

6. The glove of claim 1, wherein said panel is formed of a material having a top surface and a bottom surface;

wherein said panel top surface further comprise of a plurality of projections or a plurality of depressions, and is configured to form a grip enhancing surface along said panel top surface, thereby enhancing the wearer's grip capabilities when gripping a golf club or sports object.

7. The glove of claim 1, wherein said panel is formed of a material having a top surface and a bottom surface;

wherein said panel top surface further comprises of a non-slip coating that provides a Shore A Durometer Coefficient of Friction of two or greater, whereby said non-slip coating is designed to create a high friction surface along said panel top surface.

8. The glove of claim 1, wherein said palmar portion is adapted to overlay all five metacarpophalangeal joints of the user's hand pinkie finger, ring finger, middle finger and thumb.

9. The glove of claim 1, further comprising of micro-recesses designed to provide ventilation, wherein the micro-recesses have a diameter of approximately 0.120 millimeters; and wherein said affixed panel is adapted to overlay the forefinger metacarpophalangeal joint, the middle finger metacarpophalangeal joint, the ring finger metacarpophalangeal joint, and the pinkie finger metacarpophalangeal joint of the wearer's hand when the glove is worn.

10. The glove of claim 1, wherein said panel is formed of a material having a top surface and a bottom surface;

wherein said panel top surface further comprises of a textured portion that is adapted to create a high friction surface along said panel top surface; and wherein said textured portion consists of a PVC coating, a nitrile coating, a latex coating, a neoprene coating, or a non-slip coating that provides a Shore A Durometer Coefficient of Friction of approximately two or greater when the glove is worn.

11. The glove of claim 1, wherein the dorsal portion is adapted to entirely overlay substantially all of a back of the wearer's hand;

wherein said affixed panel is adapted to overlay the forefinger metacarpophalangeal joint, the middle finger metacarpophalangeal joint, and the ring finger metacarpophalangeal joint of the wearer's hand when the glove is worn; and wherein said affixed panel is further adapted to overlay the wearer's pinkie finger metacarpophalangeal joint leaving an upper-palmar crease free of said panel coverage when the glove is worn, thereby providing an optimal combination of grip capability and flexibility for the wearer when the glove is worn.

12. A new sports glove having a glove body comprising a palmar portion, a dorsal portion and a distal lateral edge, wherein the palmar portion and the dorsal portion meet at the distal lateral edge and are conjoined by sewing, thereby creating a permanently conjoined glove body;

wherein said glove body includes four digital segments projecting from the distal lateral edge of the body, the four digital segments permanently secured on said glove body and comprising a first digital segment, a second digital segment, a third digital segment and a fourth digital segment designed to entirely cover a pinkie finger, a ring finger, a middle finger and a thumb, respectively, of a wearer without providing a digital segment for a forefinger;

a terminal edge at the distal lateral edge of the body designed to allow the forefinger to extend past the terminal edge to completely expose the wearer's forefinger when the glove is worn;

wherein said palmar portion and said dorsal portion are conjoined by sewing, and wherein said four digital segments are permanently secured on said glove body either by sewing or by being integrally formed on said glove body;

wherein said first digital segment overlaying the wearer's pinkie finger further comprises a textured portion comprising of a plurality of projections, said textured portion is adapted to provide a coefficient of friction higher than the untextured portion of the glove body palmar portion surface, thereby providing added grip capabilities along the wearer's pinkie finger where the golf club or sporting device is gripped when the glove is worn;

wherein the wearer's forefinger is free of said textured portion when the glove is worn, wherein said third digital segment overlaying the wearer's middle finger is free of said textured portion and is therefore untextured, when the glove is worn;

wherein said palmar portion is adapted to overlay the metacarpophalangeal joint of the wearer's thumb, forefinger, middle finger, ring finger and pinkie finger when the glove is worn;

wherein said palmar portion further comprises a textured portion and is affixed and adapted to overlay at least one of the wearer's metacarpophalangeal joints when the glove is worn; and wherein said first digital segment palmar portion further comprises a plurality of projections, or a plurality of depressions, thereby providing a wearer with enhanced grip capabilities along the thumb of a wearer's hand.

13. The glove of claim 12, wherein the palmar portion surface further comprises a textured portion, said textured portion is adapted to provide a higher coefficient of friction than an untextured portion of the glove body palmar surface, thereby providing added grip capabilities along the area where the golf club or sporting device is gripped.

14. The glove of claim 12, wherein said palmar portion is adapted to overlay the entire palm of the wearer;

wherein the glove dorsal portion and palmar portion are conjoined by sewing;

wherein said textured portion comprising a plurality of projections; and wherein said textured portion is adapted to provide a coefficient of friction higher than the untextured portion of the glove body palmar portion surface, thereby providing added grip capabilities along the area where the golf club or sporting device is gripped when the glove is worn.

15. The glove of claim 12, wherein said first digital segment, second digital segment, third digital segment and fourth digital segment are sewn on said glove body; and wherein said first digital segment overlaying the wearer's pinkie finger further comprises a textured portion, said textured portion is adapted to provide a coefficient of friction higher than the untextured portion of the glove body palmar portion surface, thereby providing added grip capabilities along the area where the golf club or sporting device is gripped when the glove is worn; and wherein the wearer's forefinger is free of any textured portion, thereby providing increased grip capabilities along the pinkie finger while simultaneously increasing tactile sensitivities along the wearer's completely uncovered forefinger when the glove is worn.

16. The glove of claim 12, wherein said palmar portion is adapted to overlay the metacarpophalangeal joint of the wearer's thumb, forefinger, middle finger, ring finger and pinkie finger when the glove is worn; and, wherein said palmar portion further comprises of high grip surface portion consisting of a textured portion, said textured portion comprising a plurality of projections, a plurality of depressions, a PVC coating, a neoprene coating or a non-slip coating that is configure to provide a Shore A Durometer Coefficient of Friction of two or greater when the glove is worn;

wherein said textured portion is adapted to provide a higher coefficient of friction along said palmar portion surface when the glove is worn, whereby said textured portion.

* * * * *